US005584515A

United States Patent [19]

Silye

[11] Patent Number: 5,584,515

[45] Date of Patent: Dec. 17, 1996

[54] DOUBLE LOCKING VEHICLE DOOR LATCH

[75] Inventor: Ronald P. Silye, Livonia, Mich.

[73] Assignee: Kelsey-Hayes Company, Romulus, Mich.

[21] Appl. No.: 366,866

[22] Filed: Dec. 30, 1994

[51] Int. Cl.[6] ..... E05C 3/06

[52] U.S. Cl. ..... 292/201; 292/DIG. 27

[58] Field of Search ..... 292/201, 216, 292/DIG. 23, DIG. 27

[56] References Cited

U.S. PATENT DOCUMENTS

| | | | |
|---|---|---|---|
| 3,365,226 | 1/1968 | Shay | 292/DIG. 27 X |
| 3,679,251 | 7/1972 | Brockman et al. | 292/DIG. 27 X |
| 4,364,249 | 12/1982 | Kleefeldt | 292/DIG. 23 X |
| 4,966,266 | 10/1990 | Yamada et al. . | |
| 4,974,886 | 12/1990 | Kleefeldt et al. . | |
| 4,978,154 | 12/1990 | Kleefeldt et al. . | |
| 4,986,098 | 1/1991 | Fisher . | |
| 5,106,133 | 4/1992 | Fukumoto et al. . | |
| 5,454,608 | 10/1995 | Dzurko et al. | 292/216 |

FOREIGN PATENT DOCUMENTS

| | | | |
|---|---|---|---|
| 522662 | 4/1955 | Italy | 292/DIG. 23 |
| 2073299 | 10/1981 | United Kingdom | 292/DIG. 23 |

*Primary Examiner*—Rodney M. Lindsey
*Attorney, Agent, or Firm*—MacMillan, Sobanski & Todd

[57] ABSTRACT

A vehicle door latch assembly including a lock mechanism actuatable between a locked and unlocked condition and providing a double locking feature. The lock mechanism includes a first locking member adapted to selectively rotate about a first axis between locked and unlocked positions respectively corresponding to the locked and unlocked conditions of the latch mechanism. A second locking member is provided which is adapted to rotate about the first axis adjacent to the first locking member. The first and second locking members may be selectively coupled and uncoupled. When coupled, the second locking member may be selectively rotated about the first axis to move the first locking member between the locked and unlocked positions. When uncoupled, the first locking member is operable to move between the locked and unlocked positions independently of the second locking member. A control member is moveable axially to couple the first and second locking members. The control member is provided with a cam surface which cooperates with another cam surface on a gear to produce the axial movement of the control member required for coupling and uncoupling of the first and second locking members.

15 Claims, 11 Drawing Sheets

160
144
138
146
140
142
136
170
172
176
174
132
134
112
114
116
130
166
168
118
131
165
122
120
120
10
164
110
106
162
14
104
100
108
12
169
102
76
76b
78
76a
82
90
80
83a
83
66
88
70
60
88
86
84
98
62
64
74
72
66
68
28
92
96
96
34
94
33
50
56
54
58
52
30
43
44
36
46
42
32
40
48
20
38
24
22
20a
16
18
20b
20
26

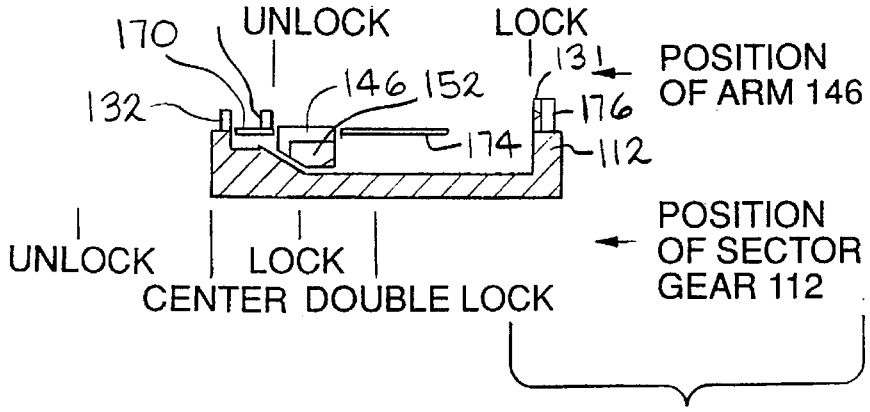
FIG. 9
FIG. 8
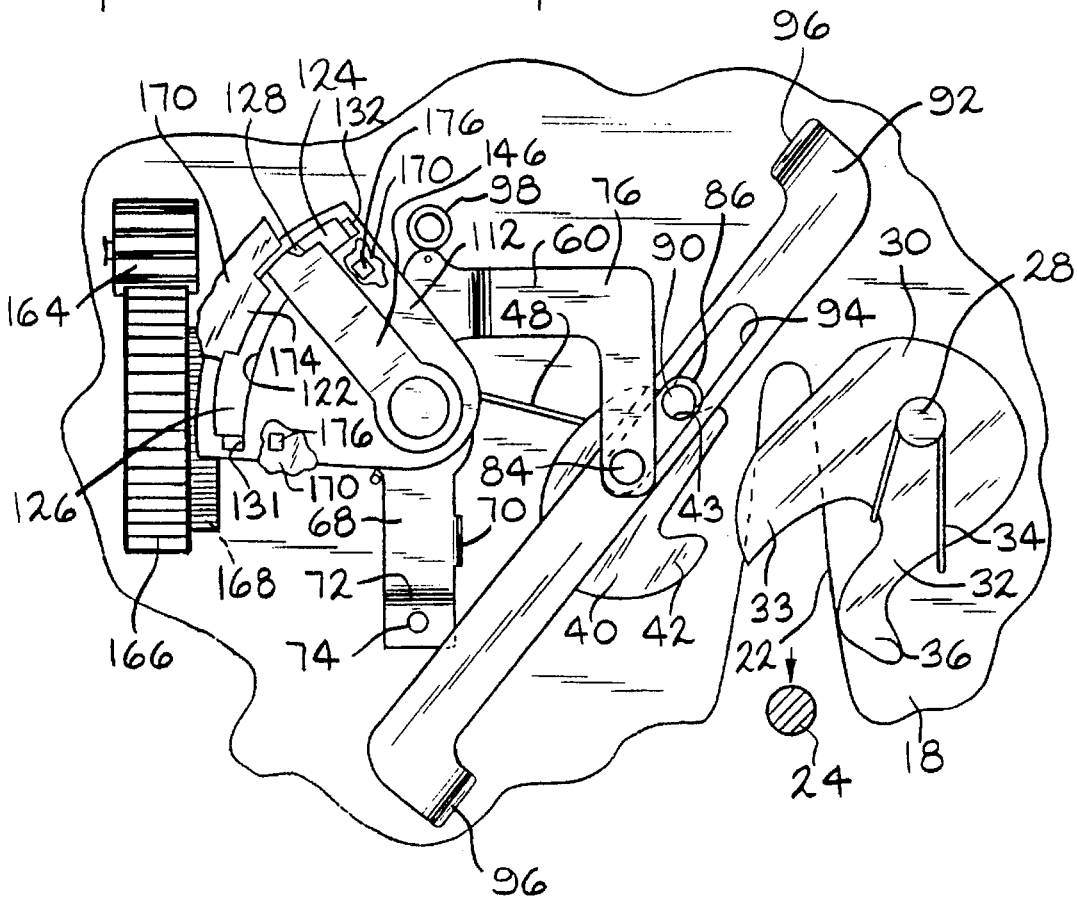

DOUBLE LOCKING VEHICLE DOOR LATCH

BACKGROUND OF THE INVENTION

This invention relates in general to electrically actuated latch assemblies and in particular to an improved structure for an electrically actuated vehicle door latch providing a double locking feature. A cam on a rotating actuator gear creates an axial movement in a control member to uncouple selected locking members from a latch mechanism and thereby lock the door latch.

Vehicles such as passenger cars are commonly equipped with individual latches which secure respective passenger and driver doors. Each latch is typically provided with an individual mechanical lock which may be key operated from the exterior of the vehicle and provided with manual means for operating inside the vehicle, e.g., a respective sill button. Further, these locks are commonly provided with a means for remote operation, such as an electrically operated mechanism for actuating the lock.

As is commonly known, the lock may be actuated to lock the door and prevent unlatching of the door. An occupant of a vehicle may lock the doors thereof, for example, to prevent entry into the vehicle by an unauthorized individual while the vehicle is at rest. The terms "latching" and "unlatching" as used herein refer to the acts of, respectively, securing a door closed and freeing the door so it can be opened. "Locking" and "unlocking" are used to refer to the act of actuating a lock mechanism to respectively prevent and permit unlatching of the door.

It has been found desirable to provide these locks with a so-called anti-theft or double lock feature. When activated, such a feature disables the interior manual operating means for the lock. The exterior operating means requires a key to be operated, and the electric operating means may be tied into an electronic vehicle security system to prevent unauthorized operation. In this condition, a thief who gains entry into the vehicle by, for example, breaking a window cannot unlock the vehicle door. A vehicle thus equipped is therefore a less attractive target for thieves.

SUMMARY OF THE INVENTION

This invention relates to an improved structure for a vehicle door latch assembly including a lock mechanism actuatable between a locked and unlocked condition and providing a double locking feature. The lock mechanism includes a first locking member adapted to selectively rotate about a first axis between locked and unlocked positions respectively corresponding to the locked and unlocked conditions of the latch mechanism. A second locking member is provided which is adapted to rotate about the first axis adjacent to the first locking member. The first and second locking members may be selectively coupled and uncoupled. When coupled, the second locking member may be selectively rotated about the first axis to move the first locking member between the locked and unlocked positions. When uncoupled, the first locking member is operable to move between the locked and unlocked positions independently of the second locking member. A control member is moveable axially to couple the first and second locking members. The control member is provided with a cam surface which cooperates with another cam surface on a gear to produce the axial movement of the control member required for coupling and uncoupling of the first and second locking members.

Various objects and advantages of this invention will become apparent to those skilled in the art from the following detailed description of the preferred embodiment, when read in light of the accompanying drawings.

BRIEF DESCRIPTION OF THE DRAWINGS

FIG. 8 is a sectional view of the sector gear and control mechanism arm taken along the line 8—8 of FIG. 2.

FIG. 9 is a view similar to FIG. 2, showing the latch mechanism in an unlocked and unlatched state.

DETAILED DESCRIPTION OF THE PREFERRED EMBODIMENT

Figure 1:
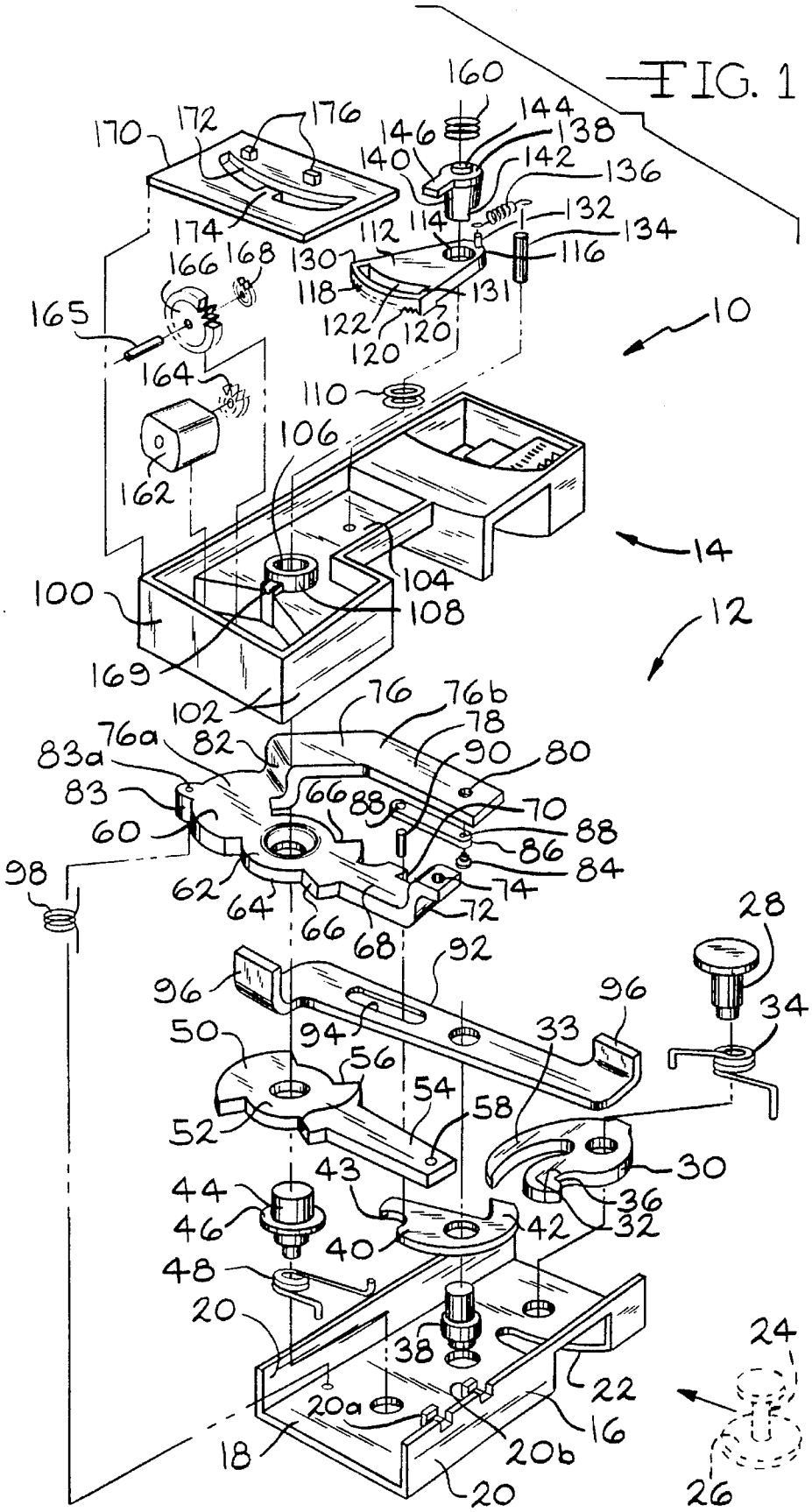
FIG. 1 is an exploded perspective view of the latch assembly of the present invention.

In the following description of the invention, certain terms will be utilized for the purpose of reference only and are not intended to be limiting. The terms "upward", "downward", "above", "below", "rightward", "leftward", "clockwise", and "counterclockwise", and words of similar import refer to directions in the drawings to which reference is made. Similarly, relational terms such as "inner" and "outer" are in reference to the geometric center of the component under discussion, unless another reference point is specifically designated.

Figure 2:
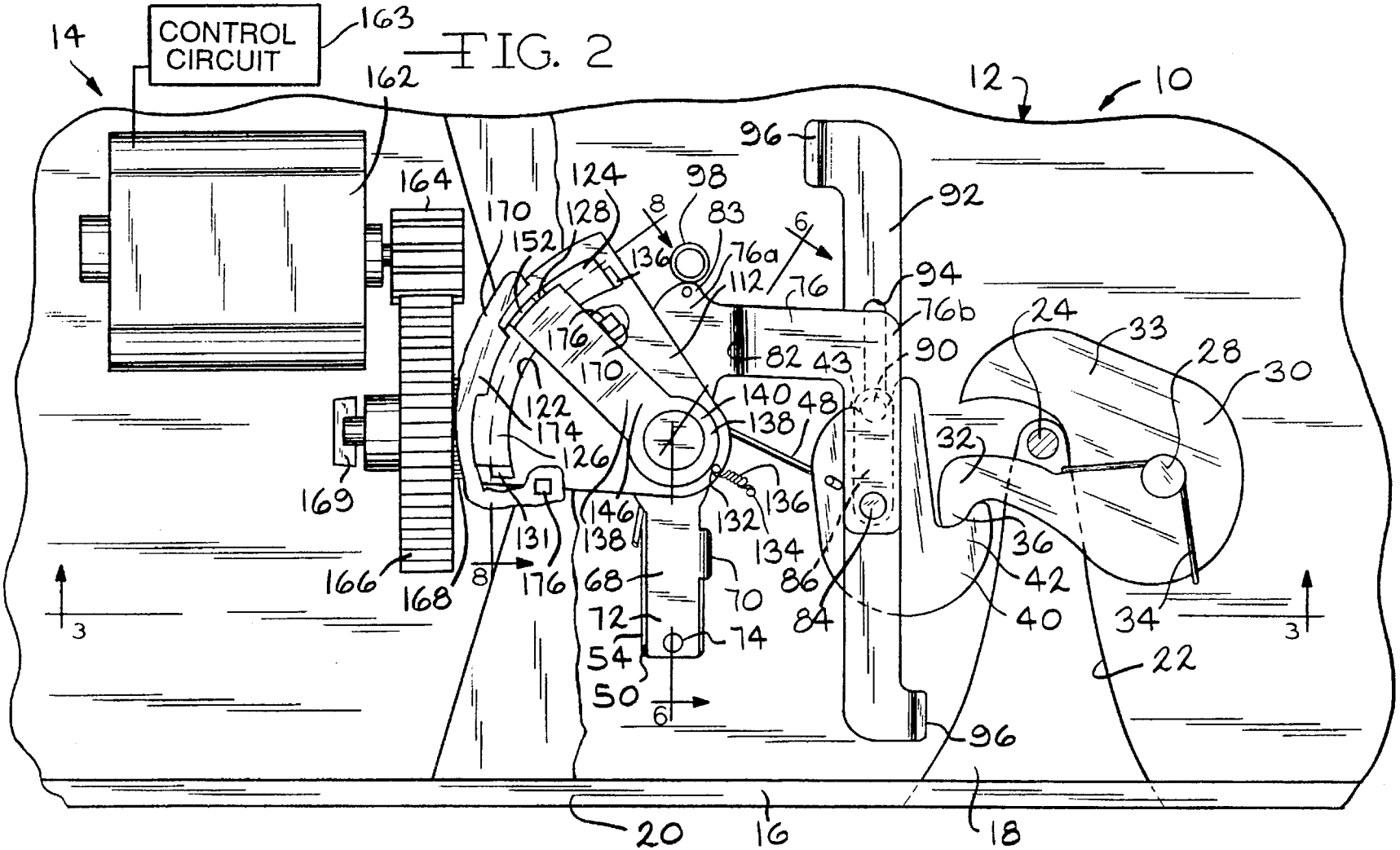
FIG. 2 is a plan view of the latch assembly of FIG. 1 illustrated with the latch mechanism in an unlocked state, with portions of the housing broken away.
Figure 3:
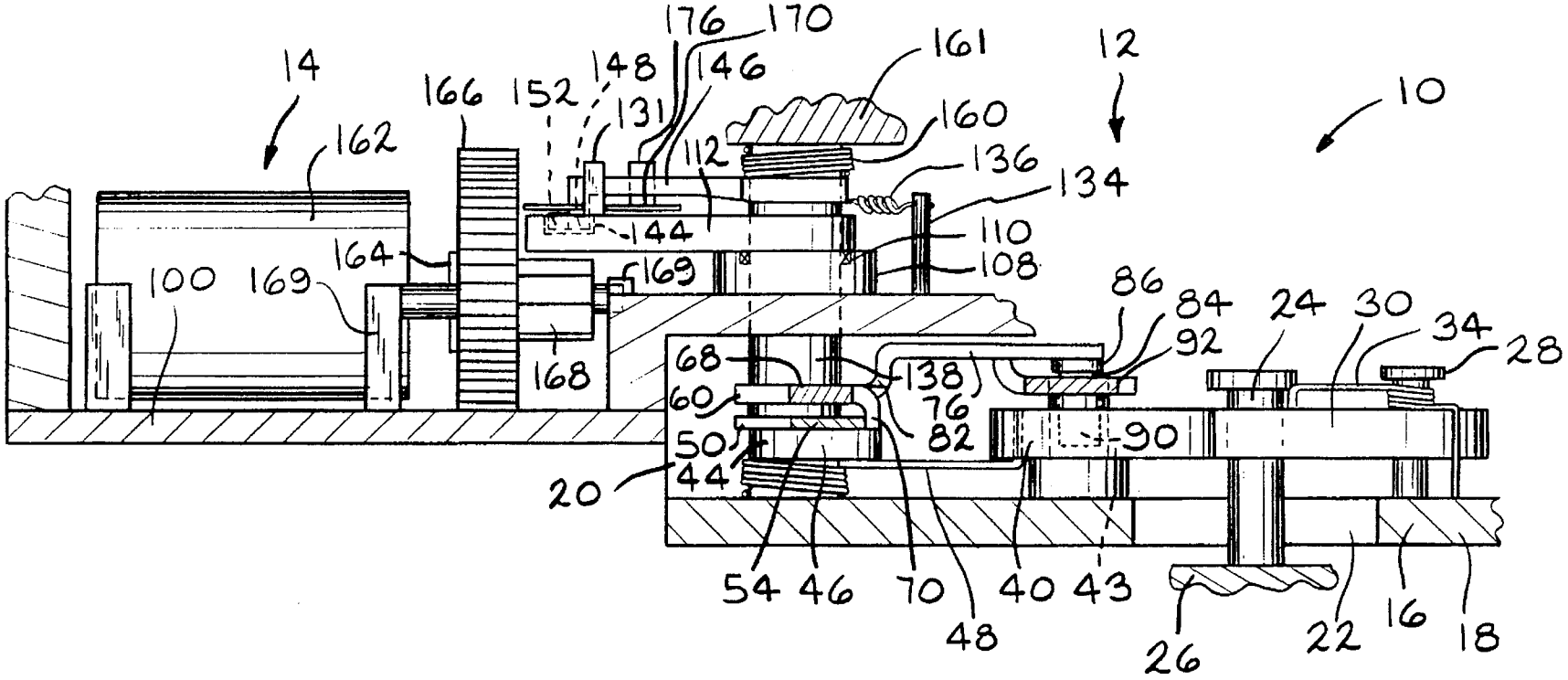
FIG. 3 is an elevational view of the latch assembly taken along the line 3—3 of FIG. 2.

Referring now to the drawings, there is illustrated in FIGS. 1, 2, and 3 a latch assembly, indicated generally at 10. The latch assembly 10 includes a latch mechanism, indicated generally at 12, and an actuator mechanism, indicated generally at 14.

The latch mechanism 12 has a U-shaped base plate 16, which is adapted to be secured to the edge of a motor vehicle door (not shown). The base plate 16 includes a planar central portion 18. A pair of flanges 20 and 21 extend upwardly from two opposed marginal edges of the central portion 18. A pair of stops 20*a* and 20*b* are formed in the flange 20, the purpose of which will be explained below. An aperture 22 is formed through the central portion 18 and the flange 20 of the base plate 16 in the form of a laterally extending notch whose inside edges converge inwardly relative to the central portion 18. The aperture 22 is adapted to engage a striker bolt 24, which is secured to a door post 26 of the vehicle.

A rotor pivot 28 is fixed perpendicularly to the base plate 16 near the aperture 22. A locking fork or rotor 30 pivotally mounted on the rotor pivot 28. The rotor pivot 28 is provided with an enlarged head portion which retains the rotor 30 on the rotor pivot 28. The rotor 30 is provided with a pair of arms 32 and 33 which engage the striker bolt 24 when the door is latched in a manner which is well known in the art. A rotor spring 34 engages the rotor 30 and an aperture in the base plate 16 to urge the rotor 30 to rotate counterclockwise. The arm 32 is formed with a projection 36, the purpose of which will be explained below.

A pawl pivot 38 is fixed perpendicularly to the central portion 18 of the base plate 16 near the rotor pivot 28. A pawl 40 is pivotally mounted on the pawl pivot 38, and includes a projection 42 which can engage the projection 36 in the rotor 30. As will be further described below, the pawl 38 may be rotated clockwise to free the projection 42 from the projection 36 on the rotor 30, and allow the latch mechanism 12 to open. The pawl 40 further includes a notch 43 formed in the perimeter thereof, the purpose of which will be explained below.

A lock member pivot 44 is fixed to the base plate 16 near the pawl pivot 38. The lock member pivot 44 defines a rotational axis perpendicular to the central portion 18 of the base plate 16. An outwardly extending flange 46 is formed about the middle portion of the lock member pivot 44. A pawl spring 48 is mounted on the lock member pivot 44 between the base plate 16 and the flange 46. The pawl spring 48 engages both the pawl 40 and an aperture in the base plate 16 to urge the pawl 40 to rotate counterclockwise, thus urging the projection 42 of the pawl 40 toward the rotor 30.

An interior lock member 50 is pivotally mounted on the lock member pivot 44 above the flange 46. The interior lock member 50 includes a generally disc shaped body 52 having an outwardly extending arm 54. Opposed notches 56 are formed in the body 52 at right angles to the arm 54, for a purpose which will be discussed later. An aperture 58 is provided at the outer end of the arm 54 to permit connecting the interior lock member 50 with a linkage operatively connected to the interior door lock operator, such as a sill button (not shown). Operation of the sill button will cause the interior lock member to rotate about the rotational axis defined by the lock member pivot 44. The body 52 and arm 54 of the interior lock member define a plane which is perpendicular to the rotational axis of the lock member pivot 44.

Figure 6:
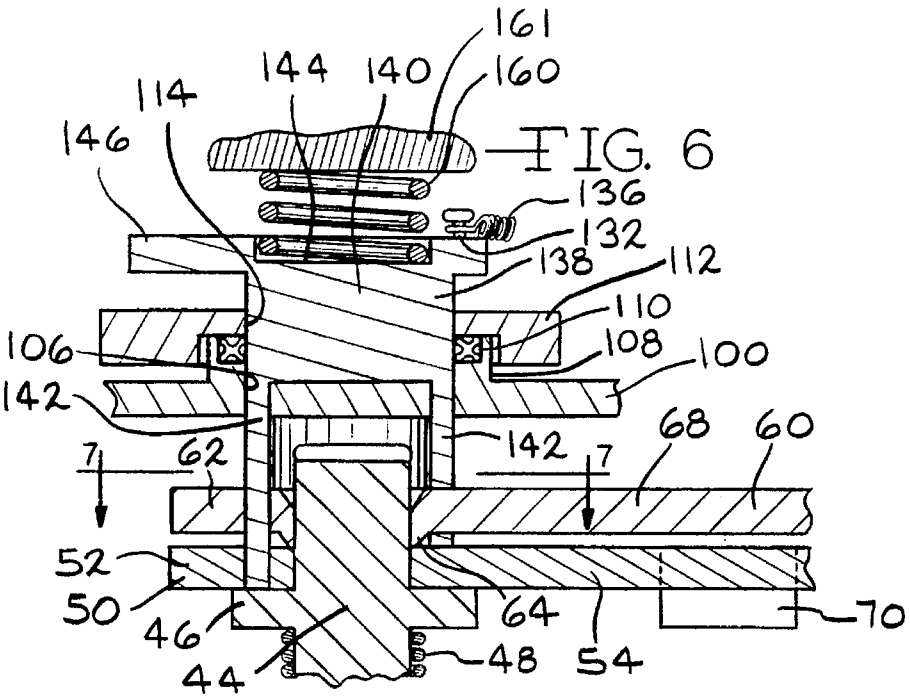
FIG. 6 is an enlarged elevational view of a portion of the latch assembly taken along the line 6—6 of FIG. 2.
Figure 10:
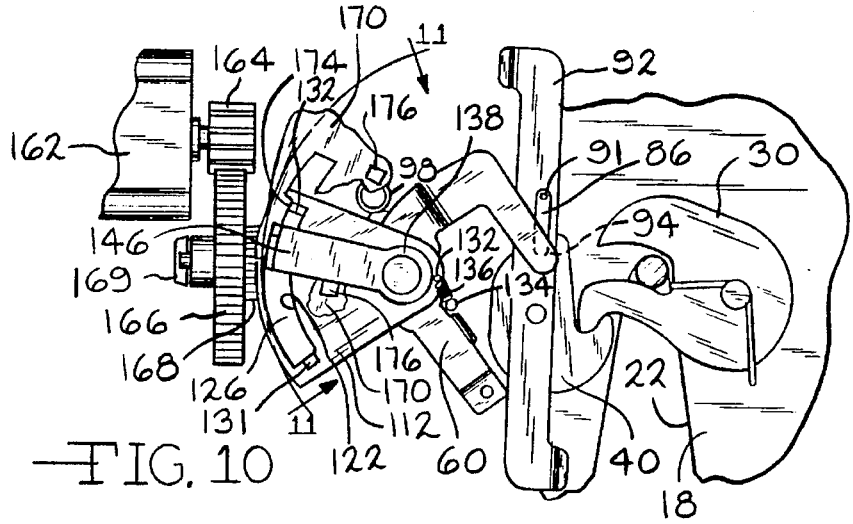
FIG. 10 is a view similar to that of FIG. 2, illustrating the latch mechanism in a locked condition before the motor is deenergized.
Figure 11:
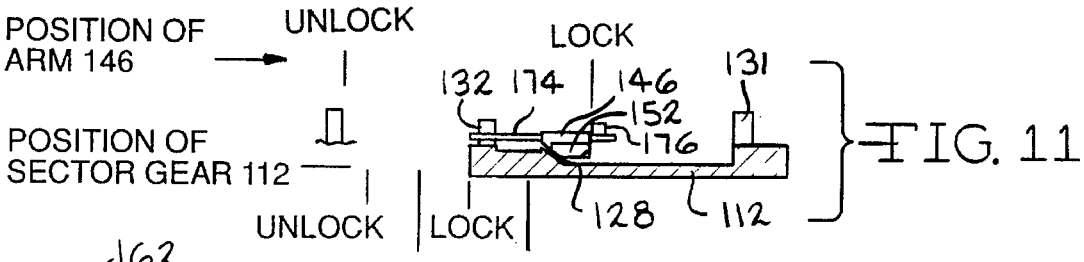
FIG. 11 is a view of the latch assembly, similar to that of FIG. 8, taken along the line 11—11 of FIG. 10.

An exterior lock member 60 is also pivotally mounted on the lock member pivot 44, above the interior lock member 50. The upper end of the lock member pivot 44 is preferably peened over after the exterior lock member 60 is mounted thereon, providing an enlarged head to retain the exterior lock member 60 and the interior lock member 50 on the lock member pivot 44 (as shown in FIG. 6). The exterior lock member 60 includes a disc shaped body 62. The body 62 defines a plane perpendicular to the rotational axis of the lock member pivot 44. The body 62 is preferably provided with a downwardly extending boss 64 about a central aperture therein. The boss 64 serves to space the body 62 of the exterior lock member 60 axially apart from the interior lock member 50 on the lock member pivot 44, as most clearly illustrated in FIG. 6. A pair of opposed notches 66 are formed in the perimeter of the body 62, the purpose of which will be discussed below.

Between each of the notches 66 on the perimeter of the body 62 is an arm, integrally formed on the body 62 of the exterior lock member 60. A first arm 68 extends radially outwardly from the body 62. The arm 68 is provided with a tab 70. The tab 70 extends downwardly into the plane defined by the body 52 and the arm 54 of the interior lock member 50. The purpose of the tab 70 will be described below. The end of the arm 68, outward of the tab 70, is bent upwardly to form a step 72. The portion of the arm 68 which is outward of the step 72 is provided with an aperture 74. This arrangement facilitates connection of the exterior lock member 60 to a linkage operated by the exterior door lock cylinder (not shown).

A second arm 76 extends from the body 62 opposite the first arm 68. As seen from above the arm 76, such as in the overhead plan view of FIG. 2, the second arm 76 is formed with two clockwise right angles 76*a* and 76*b*. Thus an end portion 78 of the arm 76 runs substantially parallel to the first arm 68. An aperture 80 is formed in the free end portion 78 above the pawl pivot 38. Additionally, an upward step 82 is formed in the second arm 76 between the the right angle 76*a* and the right angle 76*b*. The step 82 elevates the end portion 78 of the arm 76 to provide clearance for the second arm 76 to move above the components mounted on the pawl pivot. The arm 76 also includes a spur portion 83 extending radially outwardly from the first right angle 76*a* of the second arm 76. An aperture 83*a* is formed in the spur portion 83*a*, the purpose of which will be explained below.

A link pivot 84 is fixed in the aperture 80, and extends downwardly, perpendicular to the lower surface of the second arm 76. An elongate link member 86 is provided with apertures 88 near each end thereof. The link member 86 is pivotally mounted on the link pivot 84, which extends through a first one of the apertures 88. The free end of the link pivot 84 is provided with an enlarged head portion to retain the link member 86 on the link pivot 84. A downwardly extending link pin 90 is fixed in the the other one of the apertures 88 in the link member 86. The free end of the link pin 90 extends downwardly into the path of rotation of the pawl 40 and may be selectively engaged by the notch 43 in the pawl 40 for a purpose which will be later described.

A release member 92 is mounted on the pawl pivot 38, above the pawl 40, and is pivotable between a normal position (shown in, for example, FIG. 2) and an unlatch position (shown in FIG. 9). The release member 92 is provided with a longitudinally extending slot 94, through which the link pin 90 of the link member 86 passes. As will be further described below, the slot 94 permits the link pin 90 to move longitudinally relative to the release member 92, while capturing the link pin 90 for rotation with the release member 92. The release member 92 is provided with upwardly extending flanges 96 at either end thereof. The flanges 96 facilitate operatively connecting the release member 92 to the latch release linkages (not shown) operated by the exterior and interior door handles (neither are shown).

A first end of an over-center spring 98 is seated in an aperture formed in the central portion 18 of the base plate 16. The other end of the over-center spring 98 is received in the aperture 83*a* formed in the spur 83 on the exterior lock member 60. The over-center spring 98 acts under compression to urge the exterior lock member 60 toward contact with the closer of the stop 20*a* or the stop 20*b* during rotation of the exterior lock member 60. The over-center spring 98 acts to keep the exterior lock member 60 in the desired position when the latch assembly 10 is not being operated.

As will be further described below, the actuator mechanism 14 allows the locking members 50 and 60 of the latch mechanism 12 to be remotely power operated to lock and unlock the latch mechanism 12. The actuator mechanism 14 is contained within a housing 100, which is mounted by conventional means (not shown) to the base plate 16. The housing 100 may be conventionally formed from, for example, a molded plastic material. Edge walls 102 extend upwardly at the periphery of a central portion 104 to increase the stiffness of the housing 100, and to enclose the components mounted within the housing 100. An opening 106 is formed through the central portion 104, and is axially aligned with the lock member pivot 44 of the latch mechanism 12. An upwardly extending collar 108 is formed about the opening 106. An annular quad O-ring seal 110, formed of a suitable elastomeric material, is seated on the collar 108 for a purpose which will be described below.

Figure 4:
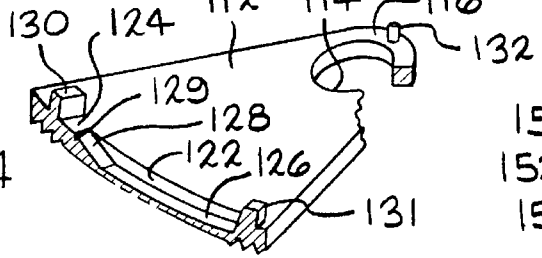
FIG. 4 is an enlarged perspective view of the sector gear illustrated in FIG. 1, with portions partially broken away for clarity of illustration.

A sector gear 112 is pivotally mounted on the collar 108. As is most clearly shown in FIG. 4, the sector gear 112 is generally triangular in outline, having an opening 114 formed therethrough in a first corner 116. The arcuate side 118 opposite the first corner 116 defines a radius about the opening 114 in the sector gear 112. A gear tooth rack 120 is formed on the lower surface of the sector gear 112. An arcuate channel 122 is formed into the upper surface of the sector gear 112. The profile of the channel 122 includes a relatively shallow portion 124 and a relatively deep portion 126. An inclined surface 128 extends between the shallow portion 124 and the deep portion 126 of the channel 122. An upwardly extending ridge 129 is formed on the shallow portion 124 of the channel 122, adjacent to the inclined surface 128. A first stop block 130 is provided on the upper surface of the sector gear 112 at one end of the channel 122, adjacent to the shallow portion 124 thereof. A second stop block 131 is provided on the upper surface of the sector gear at the other end of the channel 122, adjacent to the deep portion 126 of the channel 122. Preferably the stop blocks 130 and 131 are integrally formed with the sector gear 112. The purposes of the varied profile of the channel 122 and of the stop blocks 130 and 131 will be discussed below. The sector gear is preferably molded of a heat resistant plastic material.

A pin 132 is fixed perpendicularly to the upper surface of the sector gear 112, between the opening 114 and the first corner 116. A spring anchor post 134 is fixed perpendicularly to the central portion 104 of the housing 100 near the first corner 116 of the sector gear 112. A centering spring 136 is stretched between the pin 132 and the spring anchor post 134 and fastened thereto. The centering spring 136 urges the sector gear 112 to rotate to a position in which the centering spring 136 is least stretched, which occurs when the sector gear 112 is in a centered position. Therefore, the centering spring 136 acts to urge the sector gear 112 to rotate to its centered position.

A control member 138 is mounted on the sector gear 112 so as to rotate and move axially upwards and downwards relative to the sector gear 112. As will become apparent, the control member 138 should be formed of a material which is relatively rigid, with good wear and torque transmitting properties. One suitable material is believed to be a powdered metal, although other materials will also be suitable. The control member 138 includes a barrel shaped body 140. The body 140 extends downwardly through the opening 114 of the sector gear, the collar 108, and the opening 106 in the housing 100. The quad O-ring seal 110 enages the body 140 to provide a leak-tight seal between the body 140 of the control member 138 and the collar 108. Thus the quad O-ring seal 110 helps to exclude any metallic wear particles from the latch mechanism 12 or other contaminants from entering the housing 100 containing the actuator mechanism 14.

Figure 5:
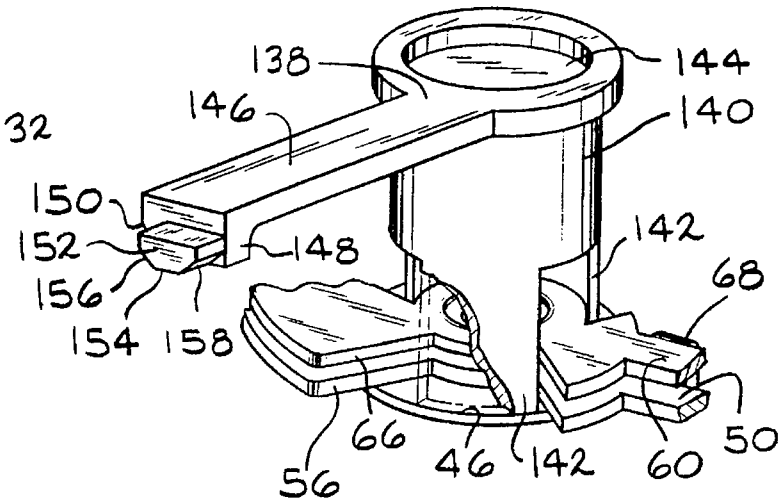
FIG. 5 is an enlarged partial perspective view of the control member and first and second locking members of FIG. 1, with portions partially broken away.
Figure 7:
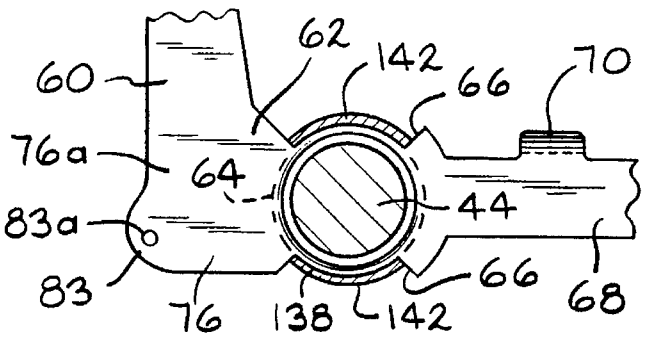
FIG. 7 is a view taken along the line 7—7 of FIG. 6.

As best seen in FIGS. 5 and 6, two fingers 142 extend downwardly from from the body 140. Each finger 142 has an arcuate cross section, as best seen in FIG. 7. As will be further explained below, the control member 138 can be selectively moved between the lowered position illustrated in FIGS. 5 and 8, and a raised position illustrated in FIG. 18. When the control member 138 is moved axially downwards to the lowered position thereof, each of the fingers 142 is disposed to engage a respective one of the notches 66 in the exterior lock member 60, and one of the the notches 56 in the interior locking member 50. Thus, when the actuator member 138 is in the lowered position thereof, the fingers 142 of the control member 138 couples the exterior and interior lock members, 60 and 50, to rotate together.

Figure 18:
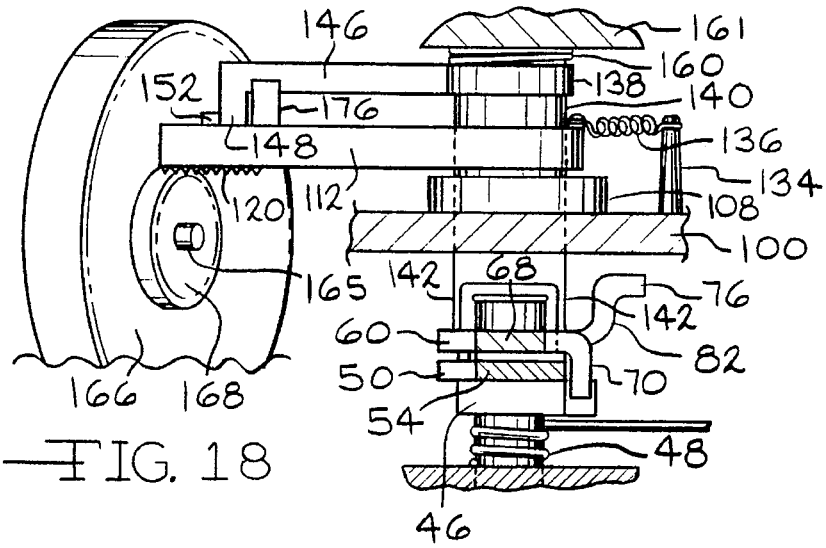
FIG. 18 is an enlarged elevational view of a portion of the latch mechanism taken along the line 18—18 of FIG. 16.

As will be further explained later, the control member 138 may be moved axially upwardly to a raised position, as illustrated in FIG. 18. In this raised position, the fingers 142 are disengaged from the interior lock member 50, but continue to engage the exterior lock member 60. In the raised position, therefore, rotation of the interior lock member 50 clockwise (away from engagement with the tab 70) will not cause the exterior lock member 60 to rotate. As will be explained below however, the tab 70 extends into the plane of rotation of the interior lock member 50, and is used to vertically re-align the interior lock member 50 with the exterior lock member 60.

A recess 144 is formed in the upper axial face of the control member 138, for a purpose which will be described below. The control member 138 further includes arm 146 extending radially outward from the upper portion of the body 140. A flange 148 extends downwardly from the free end of the arm 146 into the channel 122 formed in the sector gear 112. The bottom surface of the flange 148 is bifurcated, with an upwardly inclined ramp 150 shown on the left in FIG. 5. The ramp 150 is adapted to cooperate with the inclined surface 128 within the channel 122 of the sector gear 112 in a manner which will be described below. Note that the ramp 150 and the inclined surface 128 are preferably cooperating helical surfaces, rather than planar surfaces. Cooperating helical surfaces maximize the mutual contact area on each and more evenly support the loads transmitted therebetween as the sector gear 112 rotates relative to the actuator member 138, thereby minimizing wear of these surfaces.

A lug 152 is formed on the radially outer surface of the flange 148. The bottom surface of the lug 152 is divided into three sections including a horizontal central bottom surface 154, and ramps 156 and 158. The ramps 156 and 158 are inclined upwardly from the central surface 154 of the lug 152 to the left and right, respectively, of the central bottom surface 154, as seen in FIG. 5. The purpose of the lug 152 and the ramps 156 and 158 will be explained below.

A coil spring 160 is seated in the recess 144 formed in the top surface of the body 140 of the control member 138. The spring 160 is compressed between the control member 138 and a cover 161 (a portion of which is shown in FIGS. 6, 3, and 18) fixed over the housing 100 to urge the control member 138 axially downward toward the lowered position thereof. As will be further discussed below, the spring 160 cooperates with the control member 138 to define a control structure for selectively coupling the exterior lock member 60 to the interior lock member 50 for rotation therewith.

A D.C. electric motor 162 is mounted within the housing 100. The motor 162 is adapted to be electrically energized by a control circuit 163 (FIG. 2) in either direction of rotation. The control circuit is entirely conventional and contains elements to receive operator input (for example, by means of a pushbutton), and to electrically energize the motor 162 to cause rotation in a desired direction for a predetermined amount of time.

The motor 162 drives the sector gear 112 to rotate in clockwise and counterclockwise directions through a gear train which includes a motor pinion 164. A shaft 165 adjacent to the motor pinion 164 has a driven gear 166 fixed thereto for rotation with the shaft 165. Additionally a driven gear pinion 168 is also fixed to the shaft 165 for rotation therewith. The motor pinion 164 meshes with and drives the driven gear 166. Rotation of the driven gear 166 causes the shaft 165 and the driven gear pinion 168 to rotate therewith. The shaft 165 is journalled at the ends thereof in mounts 169 in a conventional manner. The rotating driven gear pinion 168 meshes with the gear tooth rack 120 of the sector gear 112, causing the sector gear 112 to rotate relative to the base plate 16. Each of the gears in the gear train from the motor 162 to the sector gear 112 is preferably molded of a suitable plastic material. Normally, the electric motor 162 will be operated only infrequently and thus it will remain relatively cool. However, during unusual periods of frequent demand, the electric motor 162 may heat up. Any heat which may be produced by operation of the electric motor 162 will be relatively confined within the housing 100. Therefore, it may be desirable for all of the components contained within the actuator 14, including the housing 100 itself to be formed of suitable heat resistant materials.

A plate 170, preferably formed of a stamped metal, is fixed to the housing 100. The plate 170 is formed with an inwardly extending arcuate slot 172 which generally lies on a radius about the axis of rotation defined by the locking member pivot 44. A tab 174 extends outwardly from the plate 170 toward the axis of rotation defined by the locking member pivot 44. The arm 146 is generally free to move relative to the plate 170. However, the lug 152 on the free end of the arm 146 must pass either above the tab 174 (when the control member 138 is in the upper position thereof) or below the tab 174 (when the control member 138 is in the lowered position thereof) when the control member 138 is rotated. The purpose of the tab 174 will be further described below. Additionally, stop blocks 176 are fixed to the lower surface of the plate 170 which limit the freedom of the sector gear 112 to rotate about the collar 108 to a relatively small arc, for a purpose which will be further described below. Note that it will be apparent to those of ordinary skill in the art that the stop blocks 176 may be mounted on other portions of the latch assembly 10 other than the plate 170, such as on the housing 100, or that other means may be provided to limit the movement of the sector gear 112.

The operation of the latch assembly 10 will now be described. Referring to FIGS. 2 and 3, the latch assembly 10 is shown in an unlocked, latched condition. That is, the striker bolt 24 is captured within the notch 22 in the base plate 16 by the leg 32 of the rotor 30, thus preventing the door post 26 from moving away from the base plate 16 and preventing the door from opening. The rotor 30 is prevented from rotating to release the striker post by the projection 42 on the pawl 40, which engages the projection 36 on the arm 32 of the rotor 30. The latch mechanism 12 is unlocked, as may be seen by the positioning of the pin 90 in the notch 43 on the pawl 40. In this position, the pin 90, which extends through the slot 94 in the release member 92 couples the pawl 40 to the release member 92 for rotation therewith. The interior lock member 50 is coupled for rotation with the exterior lock member 60 by the fingers 142 of the control member 138, which is in the lowered, unlock position thereof. The center spring 136 holds the sector gear 112 in the center position thereof.

To open the vehicle door when the latch assembly 10 is in the unlocked and latched condition illustrated in FIGS. 2, 3, and 8, the user will actuate the interior or exterior door release mechanisms by means of an operating button or handle (not shown). This will cause the linkage of the selected release mechanism to act against the associated flange 96 of the release member 92, causing the release member 92 to rotate clockwise to the unlatch position shown in FIG. 9. As the release member 92 rotates, the pin 90 is driven into the side of the notch 43 in the pawl 40, causing the pawl 40 to rotate clockwise against the urging of the pawl spring 48. The link member 86 pivots about the link pivot 84 to accommodate the relative motion between the release member 92 and the exterior lock member 60. As the pawl 40 rotates, the projection 42 on the pawl 40 is disengaged from the projection 36 on the rotor 30. This allows the spring 34, together with any force exerted by the user on the door and transmitted through the latch bolt 24, to rotate the rotor 30 counterclockwise to release the latch bolt 24 from the aperture 22 in the base plate 16. The vehicle door is then free to open. The user can then release the interior or exterior door release mechanism handle, which will spring return to the unactuated position thereof. This allows the release member 92 and the pawl 40 to be driven by the pawl spring 48 back to their respective unactuated positions, shown in FIGS. 2 and 3.

When the vehicle door is closed, the latch bolt 24 reenters the aperture 22 and strikes the arm of the rotor 30, causing the rotor 30 to rotate clockwise. The arm 32 of the rotor will strike the projection 42 on the pawl 40, causing the pawl 40 to rotate clockwise until the projection 36 of the arm 32 on the rotor 30 is rotated past the projection 42. The pawl 40 will then rotate counterclockwise under the urging of the pawl spring 48, causing the projection 42 to catch behind the projection 36 on the arm 32 of the rotor 30, capturing the striker bolt 24. The latch assembly 10 is thus returned to the unlocked and latched condition illustrated in FIGS. 2 and 3.

Figure 12:
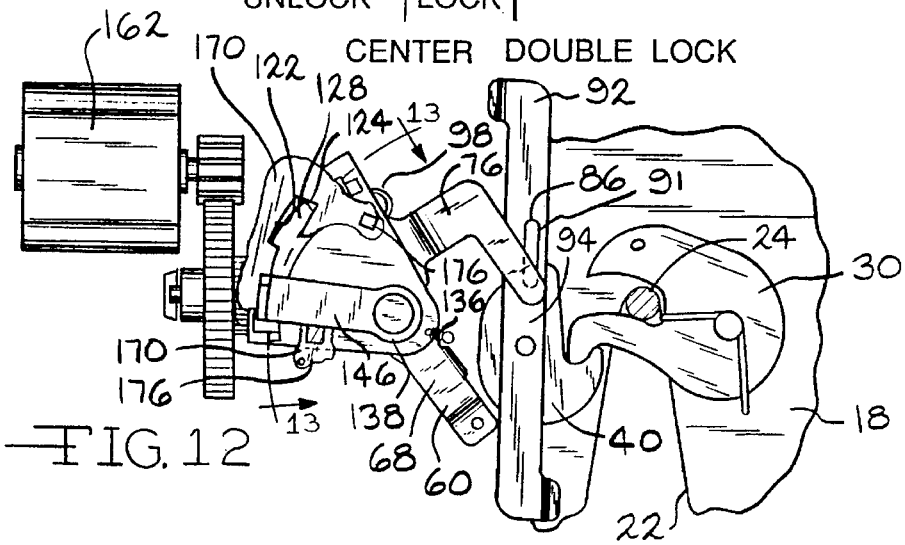
FIG. 12 is a view similar to that of FIG. 10, illustrating the latch mechanism in a locked condition, with the motor deenergized.
Figure 13:
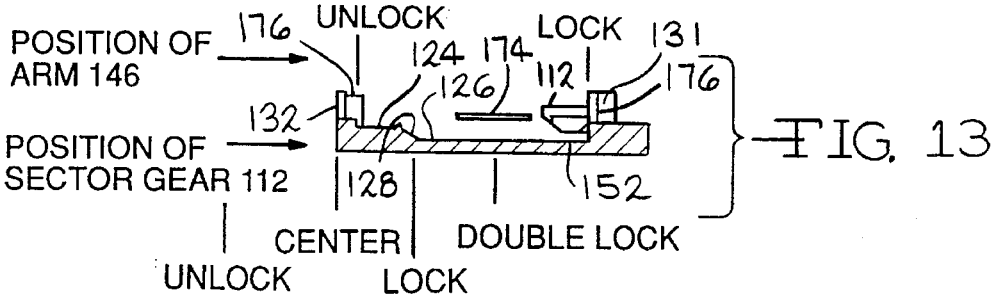
FIG. 13 is a view of the latch assembly, similar to that of FIG. 11, taken along the line 13—13 of FIG. 12.

The latch assembly 10 may be locked electrically, using the motor 162, or manually from inside of the vehicle (typically by using a sill button, not shown) or from outside of the vehicle using a key. Referring now to FIGS. 2, 3, 8, 10, and 11, the user operates the control circuit 163 to momentarily electrically energize the motor 162. It is anticipated that the motor 162 need only be energized a short period, perhaps 0.2 seconds, to drive the sector gear 112 in a counterclockwise direction (to the right in FIG. 11) to the lock position thereof. It is expected that the motor 162 will be deenergized shortly before the sector gear 112 reaches the lock position, but that momentum will drive the sector gear 112 the remaining distance to the lock position thereof. Note that the sector gear 112 does not strike any of the stop blocks 176 in the lock position thereof, but as will be explained below, may be stopped by the control member 138 if it attempts to overshoot its locked position. The sector gear 112 will then be returned to the centered position thereof by the center spring 136, backdriving the motor 162 and associated gear train, as shown in FIGS. 12 and 13.

As the sector gear 112 rotates, the inclined surface 128 of the sector gear 112 bears against the ramp 150 on the arm 146 and the ramp 156 on the lug 152 on the arm 146, driving the arm 146 counterclockwise to rotate the control member 138 to the lock position thereof. The control member 138 and components of the latch mechanism 12 coupled for rotation therewith move relatively easily. Therefore, not enough resistance is developed thereby to cause the arm 146 to ride up the inclined surface 128 against the downward force of the spring 160.

As the control member 138 rotates, the fingers 142 thereof rotate the exterior lock member 60 counterclockwise. This causes the free end portion 78 of the arm 76 to move generally toward the slot 94 in the release member 92. The over-center spring 98 is compressed until the exterior lock member 60 passes the mid-point of travel, then acts to urge the exterior lock member 60 counterclockwise toward the lock position thereof. The link member 86, pivotally driven by the free end portion 78 at one end, and guided by the pin 90 in the slot 94 in the release member 92 in the other, drives the pin 90 out of the notch 43 in the pawl 40. Thus, the release member 92 is uncoupled from the pawl 42, and the latch assembly 10 is locked.

Note that the rotation of the exterior lock member 60 is limited by the stops **20*a* and 20*b* formed on the flange 20 of the base plate 16. Those of ordinary skill in the art will recognize that other means may be used to limit the rotation of the exterior lock member 60. For example, stops could be formed on the central portion 18 of the base plate 16, on either side of the arm 68. When the exterior release member 60 rotates counterclockwise, it hits the stop 20*b*, preventing further rotation of the exterior release member 60 and thus preventing further rotation of the control member 138. The over-center spring 98 holds the exterior release member 60 against the stop 20*b*. If the sector gear 112 attempts to coast past the lock position, the sector gear 112 and the deenergized motor 162 have insufficient momentum to drive the inclined surface 128 of the sector gear 112 under the ramp 150 on the arm 146, because of the downward pressure of the spring 160 on the control member 138. Thus, the sector gear 112 will reverse direction of rotation at the stop position, and spring return to the center position thereof, while the control member 138 and the arm 146** thereof remain in the lock position.

As indicated above, the latch assembly 10 can also be locked manually from inside or outside of the vehicle. Depressing a sill button (or similar device) inside the vehicle will actuate the interior lock mechanism (not shown). The interior lock mechanism is coupled to the interior lock member 50 as described above, and will cause the interior lock member 50 to rotate counterclockwise. This causes the control member 138 to rotate the exterior lock member 60 in the same way that the control member 138 rotates the exterior lock member 60 during electrical locking of the latch assembly 10, as described above. Although the arm 146 of the control member 138 rotates to the lock position, the sector gear 112 will remain in the center position. Thus, following manual locking of the latch assembly 10, the components of the latch assembly 10 will be in the positions shown in FIGS. 12 and 13.

Manually locking the latch assembly 10 from outside the vehicle will actuate the exterior lock mechanism, which is directly coupled to the exterior lock member 60. The resultant locking operation of the latch assembly 10 as the exterior lock member 60 is rotated will be identical to that described above for locking from the interior of the vehicle. This is because the interior lock member 50 and the exterior lock member 60 are coupled for simultaneous rotation by the control member 138.

Unlocking of the latch assembly 10 can similarly be accomplished electrically by actuating the control circuit 163, or manually from inside or outside the vehicle. When the operator desires to unlock the latch assembly 10 electrically, the input pushbutton signals the control circuit 163 to energize the motor 162 for rotation in the opposite direction to that required for locking. Again, the control signal will energize the motor 162 for only a fraction of a second, which is sufficient to drive the sector gear 112 from the center position thereof to the unlock position thereof. It is anticipated that the motor 162 may be deenergized just before the sector gear 112 reaches the unlock position, and inertia of the motor 162, and associated gearing, including the sector gear 112, carry the sector gear to the unlock position. At the unlock position, the sector gear 112 strikes the adjacent stop block 176 and then reverses direction under the influence of the center spring 136. The center spring 136 drives the sector gear 112 back to the center position.

Figure 14:
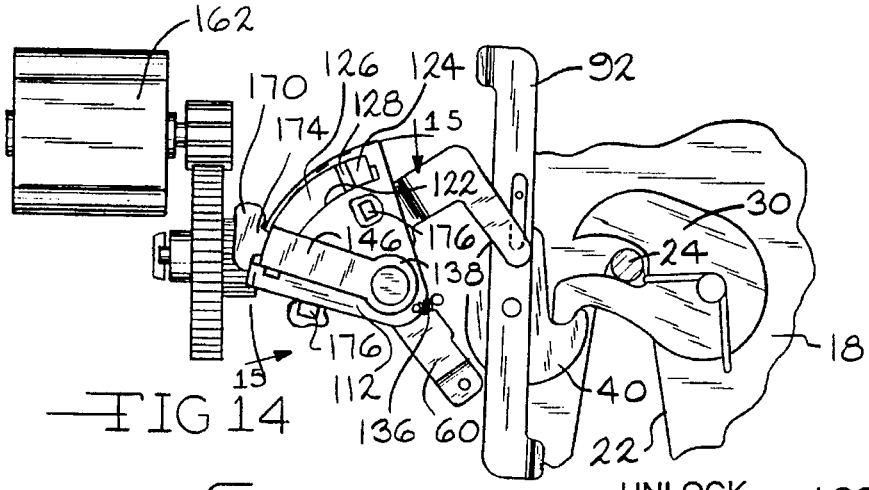
FIG. 14 is a view similar to that of FIG. 12, illustrating the latch mechanism in an intermediate position while unlocking from a locked position.
Figure 15:
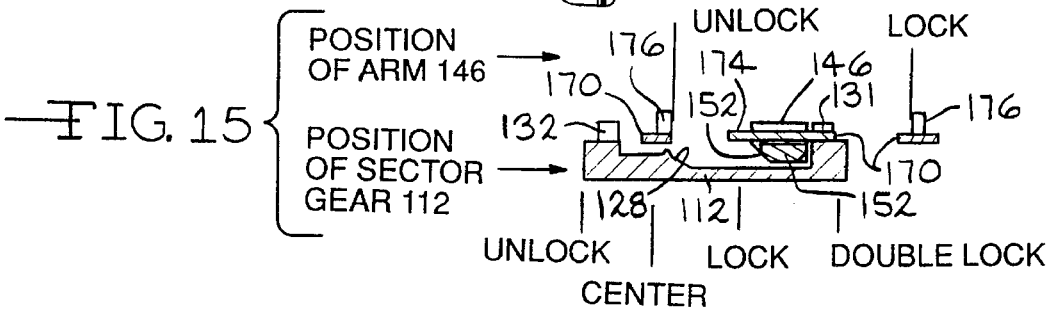
FIG. 15 is a view of the latch assembly, similar to that of FIG. 13, taken along the line 15—15 of FIG. 14.

As the sector gear 112 drives toward the unlock position, the end of the channel 122 in the sector gear 112 which is near the stop block 131 engages the flange 148 on the arm 146 of the control member 138. Thus the sector gear 112 rotates the control member 138 and the arm 146 thereon clockwise to the unlock position, as shown in FIGS. 14 and 15. When the sector gear 112 spring returns to the center position, the control member 138 and arm 146 thereof remain in the unlock position. The fingers 142 on the control member 138 rotate the exterior lock member 60 along with the interior lock member 50 clockwise to the unlock position thereof. Thus, the exterior lock member 60, acting through the link member 86 moves the pin 90 within the slot 94 in the release member 92 and radially inwardly into the notch 43 in the pawl 40. The exterior lock member 60 will be held in the unlock position thereof by the over-center spring 98. The pawl 40 and the release member 92 are thus coupled by the pin 90, as shown in FIG. 2, and the latch assembly 10 is returned to the latched, unlocked state.

Locking of the latch assembly 10 from inside or outside of the vehicle results in identical operation of the interior lock member 50 and the exterior lock member 60, since they are coupled by the control member 138. In either case, the rotation of the exterior lock member 60 will cause the pin 90 to engage the notch 43 in the pawl 40, coupling the pawl 40 to the release member 92, unlocking the latch assembly 10. As the interior lock member 50 and the exterior lock member 60 rotate with the control member 138, the arm 146 of the control member 138 moves to the unlock position thereof. The sector gear 112 remains in the center position thereof.

The latch assembly 10 may also be placed a double lock condition, in which the latch mechanism 12 is locked, and the interior lock mechanism is disabled to prevent unlocking the latch mechanism 12 from inside the vehicle. To help ensure that the user does not unintentionally disable the interior lock mechanism, typically a separate control action will be required to double lock the latch assembly 10 which is distinct from the control action required to lock the latch assembly 10. For example, the control circuit 163 may be provided with a pushbutton for double-locking which is separate from the pushbutton for locking, and wired to require both pushbuttons be depressed simultaneously to achieve double locking.

The operation of the latch assembly 10 during double-locking is initially the same as in locking as described above, except that the motor 162 is energized for a longer period of time (typically about 0.6 seconds). The sector gear 112 moves counterclockwise from the position illustrated in FIG. 2 if the latch assembly 10 is initially unlocked, or from the position illustrated in FIG. 12 if the latch assembly 10 is initially locked. The inclined surface 128 of the sector gear 112 engages the flange 148 and lug 152 on the arm 146 of the control member 138, rotating the arm 146 to the lock position thereof, if the arm 146 is not already in the lock position. The motor 162 continues to drive the sector gear 112 counterclockwise toward the double-lock position thereof after the arm 146 has butted up against the stop 176. This causes the inclined surface 128 of the sector gear 112 to cooperate with the ramp 150 on the flange 148 and the ramp 156 on the lug 152 to cause the arm 146 of the control member 138 upwards.

Figure 16:
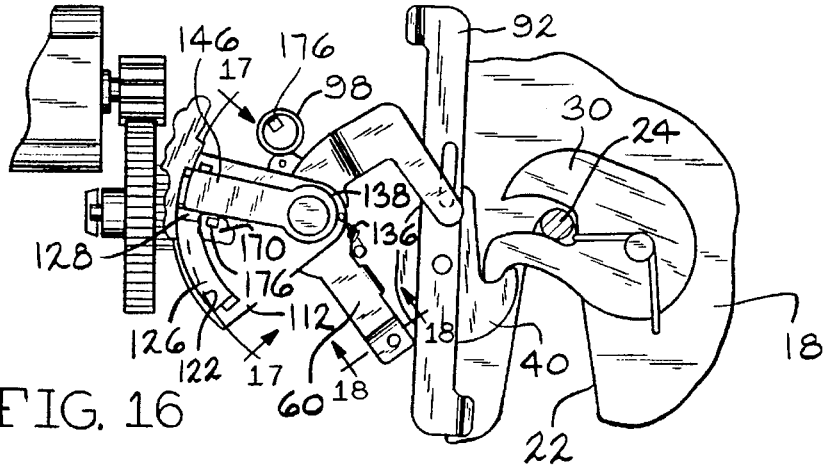
FIG. 16 is another view similar to that of FIG. 12, illustrating the latch mechanism in a double locked position.
Figure 17:
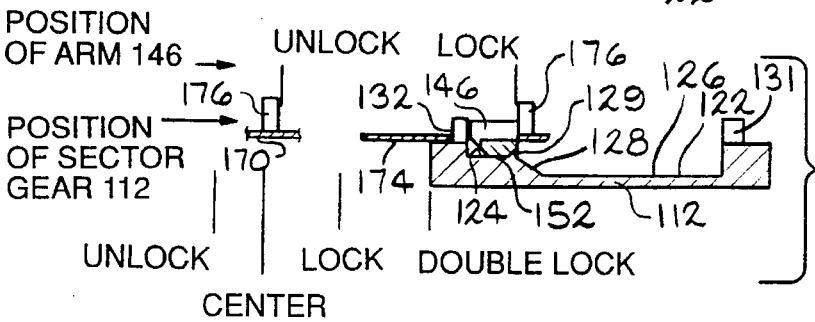
FIG. 17 is a view of the latch assembly, similar to that of FIG. 15, taken along the line 17—17 of FIG. 16.

The arm 146 is a stiff member, and thus the control member 138 is moved upwardly with the arm 146, compressing the spring 160. The motor 162 should be energized long enough to cause the ridge 129 in the channel 122 to drive under and then to the right of the flange 14 (as seen in FIGS. 16 and 17). The spring 160 will cause the control member 138 to drop slightly, until the flange 148 on the arm 146 thereof rests on the shallow portion 124 of the channel 122. The ridge 129 helps prevent the flange 148 of the arm 146 from inadvertently slipping off of the shallow portion 124 and down the inclined surface 128, due to vibration of the vehicle for example, thus holding the control member 138 in the raised position.

As shown in FIG. 18, moving the control member 138 to the raised position thereof causes the fingers 142 to disengage from the notches 56 (FIG. 1) in the interior lock member 50. The interior lock member 50 is thus no longer coupled for rotation with the exterior lock member 60. Thus operation of the interior lock mechanism (not shown) by means of a sill button and causing the interior lock member 50 to rotate clockwise will be ineffective to unlock the latch assembly 10, since the exterior lock member 60 will not be rotated thereby. The exterior lock member 60 will continue to act through the link member 86 to keep the pin 90 disengaged from the notch 43 in the pawl 40, and thus the latch mechanism 12 will remain locked regardless of how the interior lock member 50 is moved. The latch assembly 10 is in the double lock position in which not only is the release member 92 uncoupled from the pawl 40, but the interior lock member 50 is uncoupled from the latch mechanism 12.

The latch assembly 10 can be taken out of this double lock position either electrically, by energizing the motor 162, or manually, by operation of the exterior lock mechanism (not shown). When returning the latch assembly 10 to unlocked from double lock position manually, typically a key cylinder (not shown) in the vehicle door is rotated by the user using a key. The key cylinder acts through the exterior lock mechanism to rotate the exterior lock member 60 clockwise. The exterior lock member 60 will act through the link member 86 to draw the pin 90 into the notch 43, unlocking the latch mechanism 12.

Operation of the interior lock mechanism while in double lock may have caused the interior lock member 50 to have rotated relative to the exterior lock member 60, causing the respective notches 56 and 66 thereof to become vertically misaligned. Therefore, provisions are made for realigning the exterior lock member 60 and the interior lock member 50 when taking the latch assembly 10 out of the double lock position either manually or electrically. As the exterior lock member 60 is rotated clockwise to the unlock position thereof, the tab 70 on the arm 68 of the exterior lock member 60 will bear against the subjacent edge of the arm 54 of the interior lock member 50 when the arm 68 and the arm 54 are vertically aligned. This indexes the arm 68 of the exterior lock member 60 over the arm 54 of the interior lock member 50. As the exterior lock member 60 continues to rotate clockwise to the unlock position, the arm 54 of the interior lock member 50 will be kept in vertically alignment with the arm 68 by the tab 70. With the arms 54 and 68 thus aligned, the pair of opposed notches 66 formed in the body 62 of the exterior lock member 60 are axially aligned with the notches 56 formed in the interior lock member 50. Thus, when the control member 138 is moved to the lowered position thereof, the fingers 142 will engage the notches 56 formed in the interior lock member 50.

As the exterior lock member 60 is rotated clockwise, the control member 138, and the arm 146 thereof, will also be rotated clockwise by means of the fingers 142 thereof, which engage the notches 66 of the exterior lock member 60. The sector gear 112 will initially rotate with the arm 146 due to the arm 146 engaging the ridge 129 across the shallow portion 124 of the channel 122 in the sector gear 112. Therefore the control member 138 will remain in the raised position thereof. The ramp 156 on the lug 152 extending from the arm 146 of the control member 138 will therefore be driven into the tab 174 as the control member 138 rotates clockwise.

As the control member 138 is further driven clockwise, the lug 152 will cam over the top of the tab 174, lifting the control member 138 higher and further compressing the spring 160. With the arm 146 of the control member 138 thus disengaged from the sector gear 112, the sector gear 112 will be moved to the center position thereof under the urging of the center spring 136. The control member 138 will continue to be driven clockwise by the exterior lock member 60, as the control member 138 does not rise enough to disengage the fingers 142 of the control member 138 from the exterior lock member 60.

When the lug 152 of the arm 146 is rotated off of clockwise edge of the tab 174, the spring 160 will urge the control member 138 downwardly. When the tab 70 vertically aligns the notches 66 of the exterior lock member 60 with the notches 56 of the interior lock member 50, as described above, the spring 160 will drive fingers 142 of the control member 138 downwardly into engagement with the notches 56 of the interior lock member 50.

When the exterior lock member 60 is moved to the fully clockwise, unlocked position thereof, the arm 146 of the control member 138 will similarly be moved to the unlocked position thereof, and the sector gear 112 will be in the center position thereof, as illustrated in FIGS. 2, 3, and 8.

When returning the latch assembly 10 to unlocked from double lock position electrically, the lug 152 on the arm 46 of the control member 138 will initially start to be driven over the top of the tab 174 by the sector gear 112. As the arm 146 starts to rise, the ridge 129 will be driven under the central surface 154 on the lug 152. Normally, it is anticipated that the arm 146 of the control member 138 will slide off of the the tab 174 to the right. The arm 146 of the control member 138 will slide down the inclined surface 128 in the channel 122 in the sector gear 112, until the fingers 142 of the control member 138 rest on the flange 46 of the lock member pivot 44, and the control member 138 is in the lowered position thereof. Note that the control member 138 is being pressed downwardly by the spring 160. The arm 146 of the control member 138 will be disengaged from the sector gear 112 in this position, and will stop until the stop block 131 on the rotating sector gear 112 drives the arm 146 under the tab 174 to the unlock position, as shown in FIGS. 14 and 15. Thus, the arm 146 will return to the lock position shown in FIG. 13, and the sector gear 112 will spring return to the center position much like when the latch assembly 10 is unlocked from the (single) locked condition.

Figure 19:
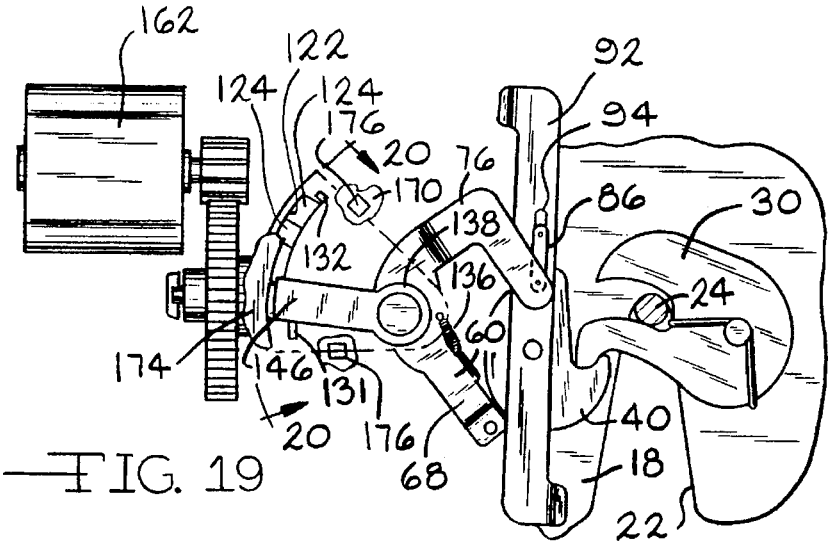
FIG. 19 is a view similar to that of FIG. 14 illustrating the latch mechanism in an intermediate position while unlocking from a double locked position.
Figure 20:
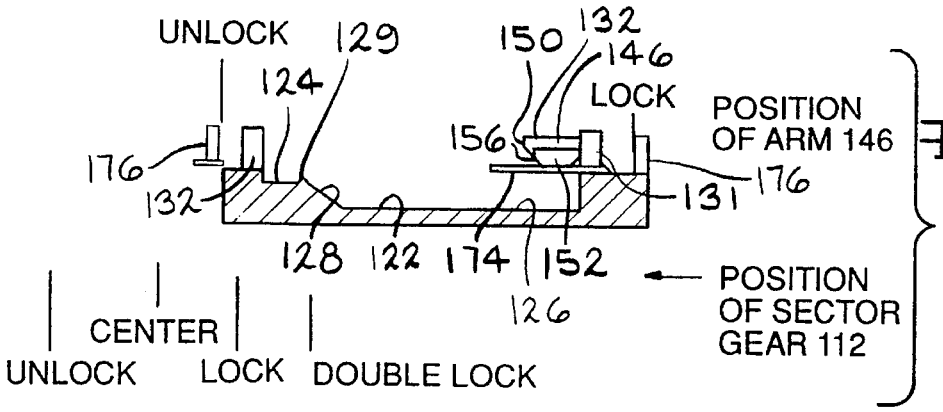
FIG. 20 is an elevational view of the latch assembly taken along the line 20—20 of FIG. 19.

However, the lug 152 may not slide off of the tab 174, as described in the preceding paragraphs, due to wear of the components or a buildup of contaminants on the surface thereof. In this case, the lug 152 on the arm 146 of the control member 138 will remain hanging by the ramp 156 on the tab 174 until the lug 152 is driven over the top of the tab 174 by the stop block 131 on the sector gear 112, as shown in FIGS. 19 and 20. When the lug 152 is moved off of the clockwise edge of the tab 174, the control member 138 will be driven downwardly by the spring 160 to reengage the notches 56 in the interior lock member 50 as described above during manual operation of the latch assembly 10. The stop block 131 will continue to drive the arm 146 of the control member 138 to the unlocked position thereof, whereupon the motor will be deenergized and the sector gear 112 will spring return to the center position. Thus the latch assembly 10 is in the unlocked, latch position shown in FIGS. 2, 3, and 8.

FIGS. 21 through 24 illustrate a second embodiment of a latch assembly according to the invention, indicated generally at 200. Those components of the latch assembly 200 which have a similar structure and function to components of the latch assembly 10 are denoted by the same reference numbers, and will not be further described.

The central portion 18 of the base plate 16 is punched to provide a bifurcated surface 204 adjacent the lock member pivot 44. The purpose of the bifurcated surface 204 will be explained below.

The upper end of the lock member pivot 44 is provided with an extension 206 of reduced diameter compared to the middle portion thereof, thereby defining a shoulder 208 between the upper end and middle portions of the lock member pivot 44. A wave washer spring 214 is seated on the upper surface of the flange 46 of the lock member pivot 44. The spring 214 resiliently supports an interior lock member 216. The interior lock member 216 includes a flat annular body 218. Extending radially outwardly from opposite sides of the body 218 are a tab 220 and an arm 222. A pair of upwardly extending flanges 224 are formed on either side of the arm 222, the purpose of which will be explained below. An additional flange 226 extends upwardly from one side of the arm 222, radially outward of the flanges 224. The flange 226 is notched to permit interconnection with the interior lock operating mechanism (not shown). The interior lock member 216 can pivot on the lock member pivot 44.

Also pivotally mounted on the lock member pivot 44, above the interior lock member 216, is an exterior lock member 228. The exterior lock member 228 has an elongate, generally rectangular body 230. The body 230 has a first end 232, a second end 234, and a pivot hole 236 formed therethrough approximately one third of the distance from the first end 232 to the second end 234. The extension 206 on the upper end of the lock member pivot 44 extends through the pivot hole 236, with the exterior lock member 228 riding on the shoulder 208 on the lock member pivot 44. The upper end of the extension 206 is preferably peened over to retain the exterior lock member 228 thereon, thereby also capturing the interior lock member 216 and spring 214 on the lock member pivot 44.

The first end 232 of the exterior lock member 228 is adapted to fit between the flanges 224 of the interior lock member 228, as will be further explained below. The second end 232 of the body 230 has an enlarged head having an arcuate slot 238 formed therethrough. The slot 238 provides a means for connecting the exterior lock member 228 to the exterior lock mechanism (not shown). A rectangular aperture 240 is formed in the second end 234, between the slot 238 and the pivot hole 236, the purpose of which will be described below.

An arm 242, similar in shape and function to the arm 76 on the exterior lock member 60, described above, extends outwardly from the exterior lock member 228 between the pivot hole 236 and the second end 234 of the body 230. The arm 242 is pivotally connected to the link member 86 by the link pivot 84. As with the exterior lock member 60, the exterior lock member 228 can be selectively rotated to cause the link member 86 to move the pin 90 into and out of alignment with the projection 43 on the pawl 40, thereby respectively unlocking and locking the latch assembly 200.

An alignment flange 244 is formed on the side of the body 230 opposite to the arm 242, between the second end 234 and the pivot hole 236. The alignment flange 244 extends downwardly, and is adapted to selectively engage the tab 220 on the interior lock member 216. For reasons which will be discussed below, the alignment flange 244 is longer than either of the flanges 224 on the interior lock member 216.

A plastic detent cam 246 is disposed in the aperture 240 in the second end 234 of the exterior lock member 228. The cam 246 is made of a resilient plastic material. The cam 246 bears on the central portion 18 of the base plate 16. As the exterior lock member 228 is pivoted about the lock member pivot 44, the cam 246 cooperates with the bifurcated surface 204 to act as an over-center spring. The cam 246 will override the bifurcated surface 204 as the exterior lock member 228 is rotated, with the cam 246 being compressed against the arm 264. After the cam 246 has been moved beyond the center point of the bifurcated surface 204, the cam 246 resiliently expands against the bifurcated surface 204 to urge the exterior lock member 228 toward the closer of a lock or an unlock position.

The housing 100 may be modified to provide recesses 250 therein. Magnetically operated switches 252 can be mounted in the recesses 250, and electrically connected to the control circuit 163 for a purpose which will be explained below. An upwardly extending collar 254 is formed around the opening 106 through the housing 100. A notch 256 is formed in the collar 254, the purpose of which will be described below.

The latch assembly 200 includes a control member 258. The control member 258 has a cylindrical body 260. Two spaced apart legs 262 extend downwardly from the body 260. An arm 264 extends radially outwardly from the upper end of the body 260. One edge of the arm 264 is inclined upwardly toward the center of the arm 264 to form an inclined surface 266. A recess 268 may be formed on the upper surface of the arm 264 for a purpose which will be described below.

The control member 258 is rotatably mounted in the collar 254, with the arm 264 captured within the notch 256. Thus the arm 264 cooperates with the vertical edges of the notch 256 to limit the rotation of the control member 258. As will be further discussed below, when the arm 264 is against the counterclockwise vertical edge of the notch 256, the control member 258 will be in the lock position thereof. When the arm 264 is against the clockwise vertical edge of the notch 256, the control member 258 will be in the unlock position thereof.

The body 260 of the control member 258 extends through the opening 106. The quad O-ring 110 provides a leak-tight seal between the body 260 of the control member 258 and the housing 100. The legs 262 straddle the exterior lock member 228 and rest on opposed portions of the body 218 of the interior lock member 216. When the spring 214 is uncompressed such that the interior lock member 216 is a raised position, the control member 258 is supported in a raised position with the arm 264 spaced upwardly from the bottom edge of the notch 256.

A magnet 270 may be provided in the recess 268 in the arm 264 of the control member 258. As the control member 258 is rotated, the magnet 270 moves over and interacts with the switches 252 to cause the switches to change state, thereby providing a signal to the control circuit 163 indicating the position of the control member 258. Such a signal may be used for control or indication purposes.

Figure 21:
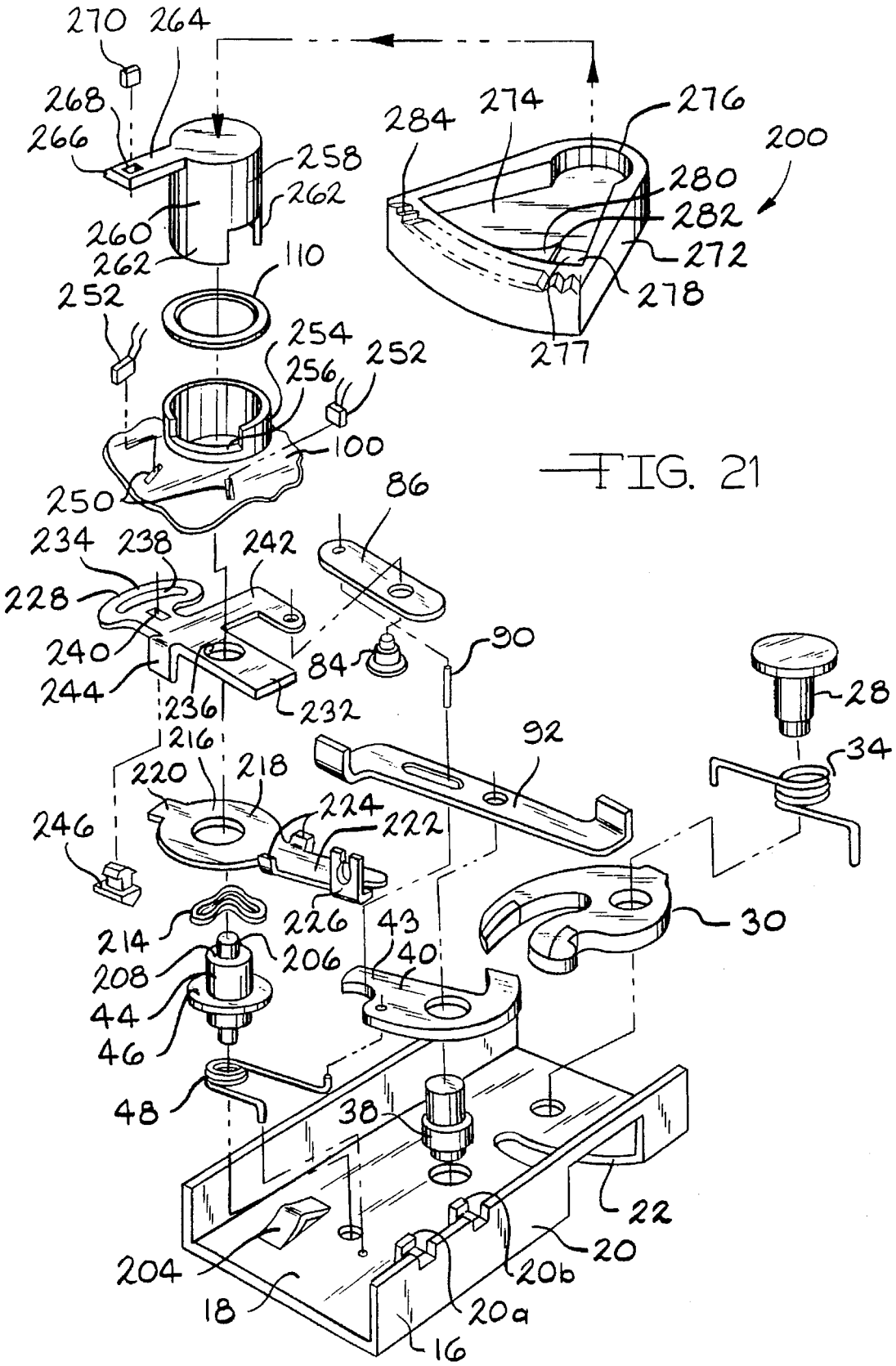
FIG. 21 is a view similar to that of FIG. 1, illustrating a second embodiment of the latch assembly of the invention.

A sector gear 272 is provided with a generally triangular cavity 274 formed on the lower side thereof (the sector gear 272 is shown inverted in FIG. 21). A generally circular portion 276 of the cavity 274 is formed about the axis of rotation of the sector gear 272. A raised member 277 is formed in a corner of the base portion of the triangular cavity 274. The raised member 277 has a lower horizontal surface 278 positioned intermediate the horizontal surface of the cavity 274 and the lower surface of the sector gear 272. The raised member 277 also includes an inclined surface 280 extending from the horizontal surface of the cavity 274 to the horizontal surface 278. A lip 282 is formed between the horizontal surface 278 of the raised member 277, the purpose of which will be discussed below.

The spring 214 urges the control member 258 upwardly against the sector gear 273. The upper surface of the sector gear 273 rides against the cover 161 of the latch assembly 200. Gear teeth are formed into the lower surface of the sector gear 272 adjacent the widest part of the cavity 274 to form an arcuate gear rack 284. The gear rack 284 meshes with the drive gear pinion 168, so that the sector gear 273 can be rotated by the motor 162. The center spring 136 acts to drive the sector gear to a center position in a manner similar to that of the latch assembly 10.

It will be appreciated that in operation the functioning of the latch mechanism 12 of the latch assembly 200 is unchanged from that of the latch assembly 10 when the latch assembly 200 is unlocked.

Figure 22:
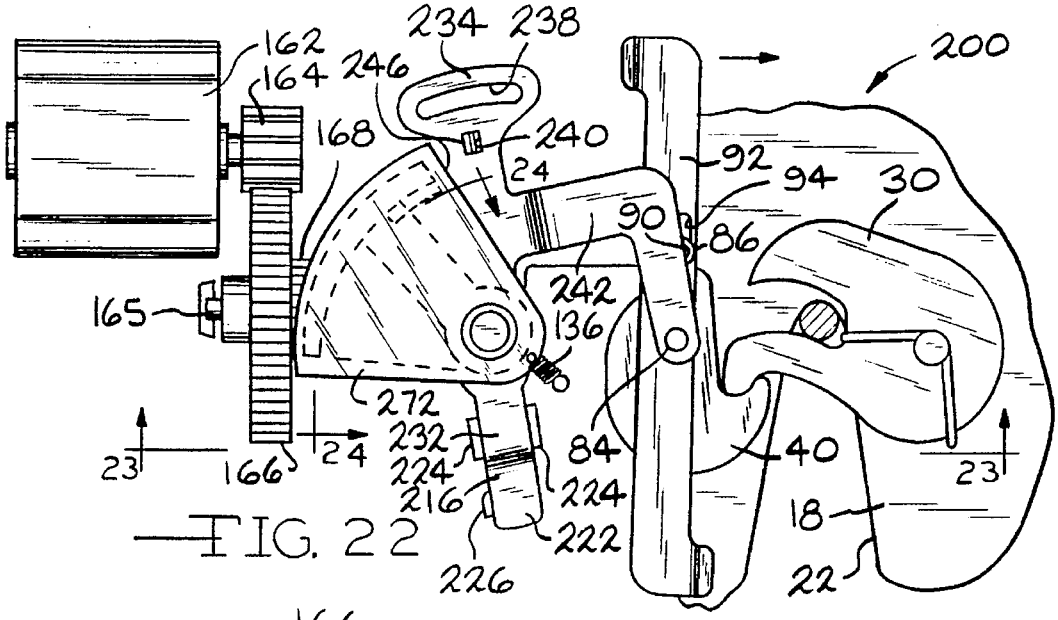
FIG. 22 is a plan view similar to that of FIG. 2 illustrating the latch assembly of FIG. 21.
Figure 23:
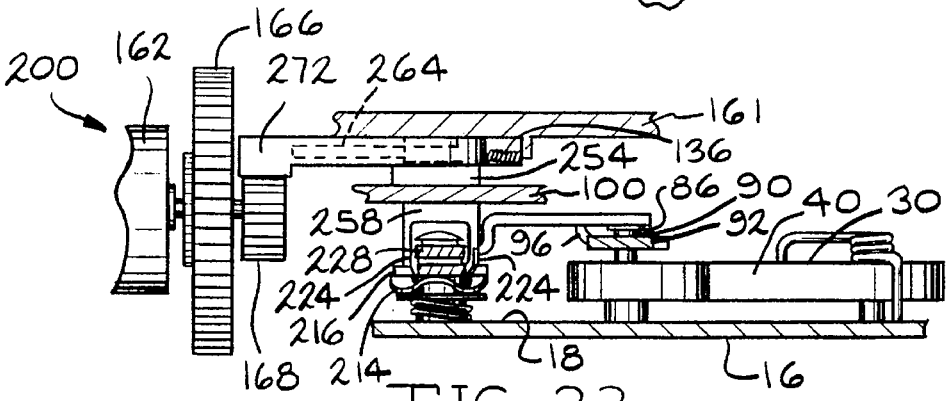
FIG. 23 is an elevational view of the latch assembly taken along the line 23—23 of FIG. 22.
Figure 24:
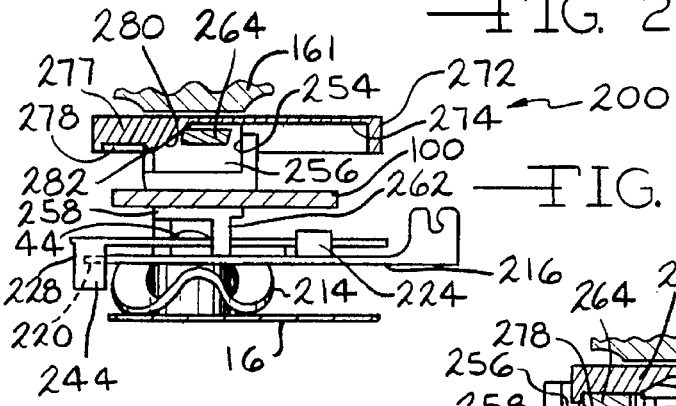
FIG. 24 is an elevational view of the arm of the control member and sector gear of the latch assembly taken along the line 24—24 of FIG. 22.

The latch assembly 200 may be locked electrically by energizing the motor 162 to drive the sector gear 272 counterclockwise as seen in FIG. 22. The raised member 277 on the sector gear 272 drives into the inclined surface 266 of the arm 264 of the control member 258. The raised member 277 does not override the arm 264, but rather urges the arm 264 and the control member 258 to rotate counterclockwise to the lock position thereof, as seen in FIG. 24. The motor 162 may be deenergized based on the lapse of a predetermined time period, or based on actuation of one or more switches 252 indicating that the motor 162 has moved the arm 264 of the control member 258 to the lock position. The legs 262 of the control member 258 cause the exterior lock member 228 to rotate counterclockwise to the lock position thereof. This causes the link member 86 to drive the link pin 90 out of alignment with the pawl 40, locking the latch assembly 200. The flanges 224 on the interior lock member 216 are engaged with the exterior lock member 228, and thus the interior lock member 216 is also rotated to the lock position thereof. When the motor 162 is deenergized, the center spring 136 drives the sector gear 272 back to the center position.

The latch assembly 200 may be manually locked from the inside or outside of the vehicle in a manner similar to that of the latch assembly 10 described above. When locking from the exterior of the vehicle, the exterior lock member 228 is directly actuated by the exterior lock mechanism to move the link member 86 to the lock position thereof. Similarly, the interior lock mechanism can be actuated to move the interior lock member 216 to the lock position thereof. The flanges 226 on the interior lock member 226 then drive the exterior lock member 228, and the link member 86 to the lock position thereof. When manually locking the latch assembly 200, the control member 258 is rotated. However, the lost motion provided by the center spring 136 having moved the sector gear 272 to the center position prevents having to back drive the motor 162 through the gear train.

The latch assembly 200 may be unlocked by energizing the motor 162 to drive the sector gear 272 in a clockwise direction (as viewed in FIG. 22). The arm 264 of the control member 258 is engaged by the vertical edge of the cavity 274 and driven to the unlock position thereof and reversing the actions of electrically locking the latch assembly 200 described above. Similarly, the latch assembly 200 may be manually unlocked from inside or outside the vehicle by operating the lock mechanism associated with the interior lock member 216 or the exterior lock member 228, respectively.

Figure 25:
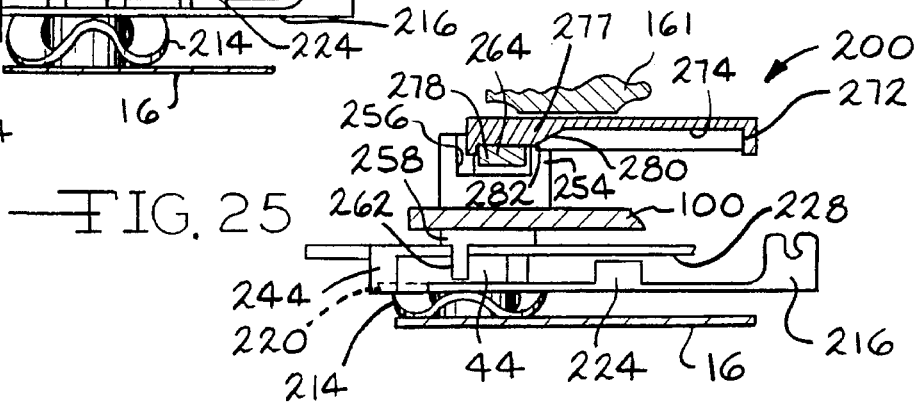
FIG. 25 is a view similar to that of FIG. 24, illustrating the latch mechanism in a double locked position.

The motor 162 may be electrically operated to place the latch assembly 200 in a double lock condition. The motor 162 is operated to drive the sector gear 272 to counterclockwise as viewed in FIG. 22. Initially, the raised member 277 merely drives the arm 264 of the control member 258 toward the lock position thereof, as shown in FIG. 24, and as described above. However, the motor 162 continues to rotate the sector gear 272 after the arm 264 has moved to the lock position and is stopped by the adjacent vertical edge of the notch 256. This causes the inclined surface 280 of the raised member 277 to cooperate with the inclined surface 266 of the arm 264 to urge the control member 258 downwardly to a double lock position, as shown in FIG. 25. The legs 262 of the control member 258 urge the body 218 of the interior lock member 216 downward, compressing the spring 214, until the horizontal surface 278 of the raised member 277 is positioned above the arm 264. The motor 162 is then deenergized.

The lip 282 on the raised member 277 engages the arm 264, holding the horizontal surface 278 of the raised member 277 above the arm 264, and holding the control member 258 depressed in the double lock position. The legs 262 of the control member 258 remain engaged with the exterior lock member 228. The cam 246 on the lower side of the exterior lock member 228 cooperates with the bifurcated surface 204 on the base plate 16 to hold the exterior lock member 228 in the lock position. Thus the center spring 136 is prevented from rotating the sector gear 272 back to the center position thereof.

When the control member 258 is depressed into the double lock position, the legs 262 thereof hold the interior lock member 216 down so that the flanges 224 on the interior lock member 216 are disengaged from the exterior lock member 228. The interior lock mechanism may be operated to rotate the interior lock member 216 to the unlock position. However, the exterior lock member 228 will remain in the lock position, and the latch assembly 200 will remain locked.

To unlock the latch assembly 200 from the double lock position, the motor 162 is energized to rotate the sector gear 272 in the clockwise direction. The arm 264 remains engaged by the lip 282 on the raised member 277 of the sector gear 272, and is urged by the lip 282 to the unlock position thereof, where the arm 264 engages the adjacent vertical edge of the notch 256 in the collar 254.

As the control member 258 is rotated by the arm 264 thereof, the legs 262 thereof urge the exterior lock member 228 to rotate to the unlock position, causing the latch assembly 200 to unlock in the manner described above. As the exterior lock member 228 rotates, the alignment flange 244 thereof engages the tab 220 on the interior lock member 216. The alignment flange 244 urges the interior lock member 216 to rotate with the exterior lock member 228 to the unlock position to ensure that the interior lock member 216 is vertically aligned with the exterior lock member 228 when the exterior lock member 228 is in the unlock position.

After the arm 264 engages the vertical edge of the notch 256, the sector gear 272 continues to rotate, causing the lip 282 of the raised member 277 to ride over the arm 264 of the control member 258. The sector gear 272 continues to rotate as the inclined surface 280 passes over the arm 264, allowing the spring 214 to urge interior lock member 216 and the control member 258 upwardly. As the interior lock member 216 moves upwardly, the flanges 224 thereon engage the exterior lock member 228, re-coupling the interior lock member 216 and the exterior lock member 228 for simultaneous rotation. After the raised member 277 is moved off of the arm 264, the motor 162 is deenergized, and the center spring 136 returns the sector gear 272 to the center position.

It is contemplated that the latch assembly 200 may be modified to include a plate 170 with tab 174, and the arm 264 of the control member 258 modified to include a lug similar to the lug 152 on the control member 138. These or other modifications may be made to permit the latch assembly 200 to be manually unlocked from the double lock condition in a manner similar to that of the first embodiment described above. It is also contemplated that the control member 258 may be modified to include multiple arms 264, and the sector gear 272 modified to provide a plurality of raised members 277 to engage the arms 264. This may be done in order to provide a balanced force and torque application to the control member 258 in the manner of the third embodiment of the invention, described below.

Figure 26:
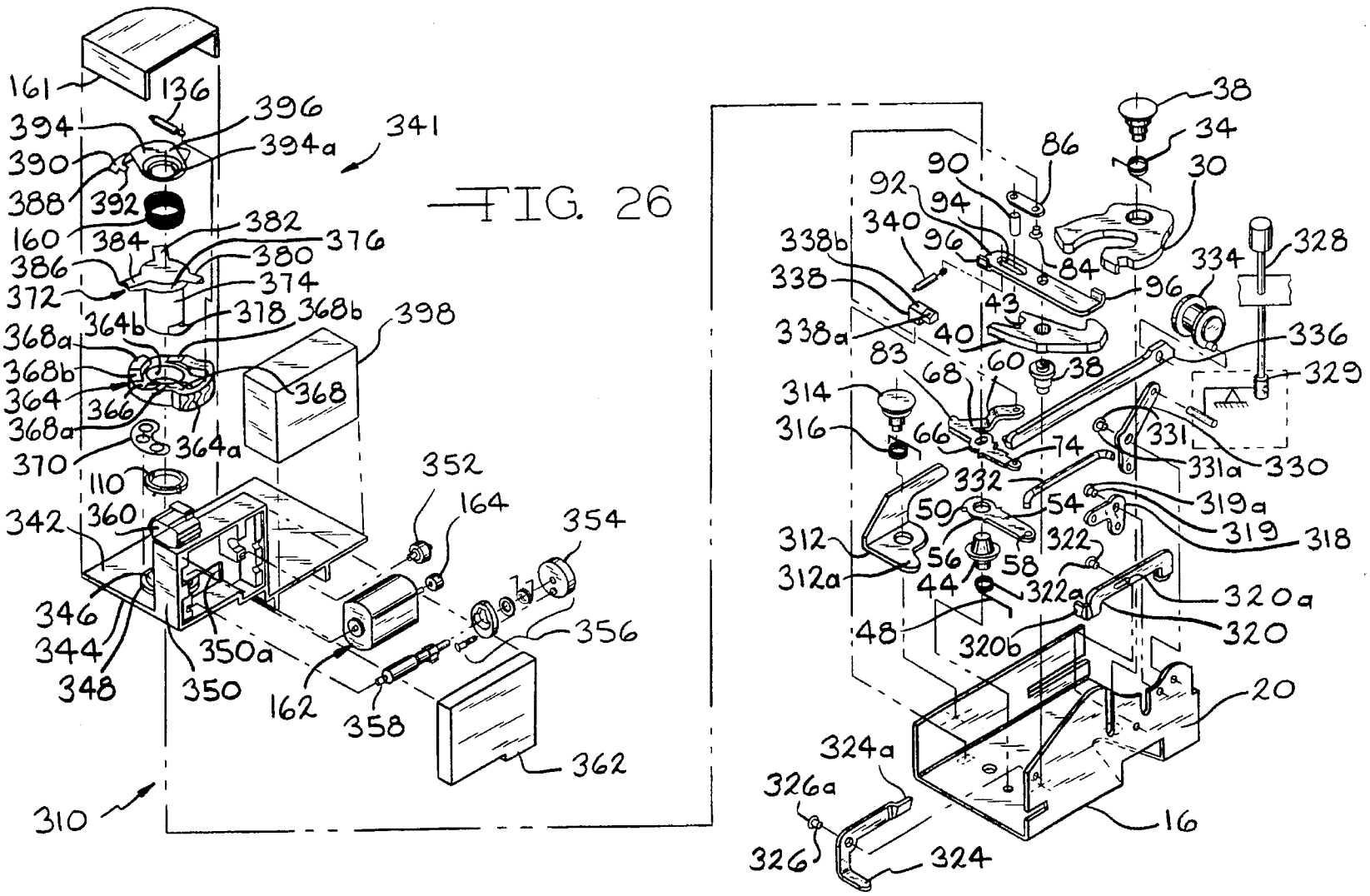
FIG. 26 is a view similar to that of FIG. 1, illustrating a third embodiment of the latch assembly of the invention.

FIG. 26 illustrates a third embodiment of a latch assembly according to the invention, indicated generally at 310. The latch assembly 310 functions in a manner similar to the latch assembly 10, and components which have a similar structure and function to the components of the latch assembly 10 are denoted by the same reference numbers.

An exterior release lever 312 forming a portion of the exterior release mechanism is pivotally mounted on a pivot 314 fixed to the base plate 16. An arm **312*a* of the lever 312 is disposed to selectively bear against one of the flanges 96 of the release member 92. The exterior release mechanism can be actuated to cause the lever 312 to rotate from a normal position to a release position, thus driving the release member 92 to the respective release position thereof. A spring 316 is provided to urge the lever 312** toward the normal position thereof.

The interior release mechanism includes a bellcrank 318. The bellcrank 318 is pivotally mounted on a pivot 319 fixed to the the flange 20 of the base plate 16. The pivot 319 has an enlarged head **319*a* to retain the bellcrank 318 on the pivot 319. The bellcrank 318 is operatively coupled to an interior release link 320. The interior release link 320 is provided with a central slot 320*a*, and a flange 320*b*. A pivot 322 extends through the central slot 320*a* and is fixed to the flange 20 of the base plate 16. The pivot 322 is provided with an enlarged head 322a for retaining the interior release link 320 on the pivot 322. The interior release link 320 can be pivoted slightly on the pivot 322, and can be moved axially relative to the pivot 322. When the bellcrank 318 is rotated clockwise (as viewed in FIG. 26) by the interior release mechanism (not shown), the flange 320*b* of the interior release link 320 is driven from an unactuated position leftward against the adjacent one of the flanges 96 of the release member 92. This causes the release member 92 to rotate clockwise to the unlatch position thereof. If the latch assembly 200 is unlocked (with the link pin 90 positioned in the radially inner end of the slot 94 in the release member 92), rotation of the release member 92 to the unlatch position will cause the pawl 40 to disengage from the rotor 30**.

A child safety lever 324 may be provided which either blocks actuation of the release mechanism, or, preferably, decouples the release mechanism from the latch mechanism.

In an embodiment in which the child safety lever 324 acts to uncouple the release mechanism from the latch mechanism, a spring (not shown) is disposed about the pivot 322 between the interior release link 320 and the flange 20. This spring acts to urge the interior release link 320 away from the flange 20. The child safety lever is pivotally mounted on a pivot 326 fixed to the flange 20 on the base plate 16. The pivot 326 is provided with an enlarged head **326*a* to retain the child safety lever 324 on the pivot 326. The child safety lever 324 is pivotal between an uncoupling position (clockwise as viewed in FIG. 26**) and a neutral position (counterclockwise).

When the child safety lever 324 is in the neutral position, the interior release link 320 is free to move to engage a tab 96 on the release member 92, causing the release member 92 to rotate and unlatch the latch assembly 310. When the child safety lever 324 is rotated to the uncoupling position, an end **324*a* of the child safety lever having an inclined surface is rotated to engage the interior release link 320, urging the interior release link 320 toward the flange 20, and compressing the spring therebetween. In this position, when the interior release link 320 is actuated, the flange 320*b* thereon will not engage the tab 96 on the release member 92. Thus, when the child safety lever 324 is in the uncoupling position thereof, the latch assembly 310** is not able to be opened from within the vehicle.

The child safety lever 324 may also be designed to block movement of the interior release link 320 to prevent operation of the release member 92. A washer (not shown) or other means is provided to fix the plane of movement of the interior release link 320 in alignment with the tab 96 on the release member 92. The child safety lever 324 is pivotally mounted on the pivot 326 fixed to the flange 20 on the base plate 16. The pivot 326 is provided with an enlarged head 326*a* to retain the child safety lever 324 on the pivot 326. The child safety lever 324 is pivotal between a non-blocking position and a blocking position. In the blocking position, the end 324*a* of the child safety lever is aligned with and adjacent to the flange 320*b* on the interior release link 320 to prevent the interior release link 320 from moving to the actuated position thereof. Thus, when the child safety lever 324 is in the blocking position thereof, the interior release link 320 is not able to engage the tab 96 to drive the release member 92 to the release position, and the latch assembly 310 is not able to be opened from within the vehicle. The child safety lever 324 may also be placed in the non-blocking position thereof, in which the end 324*a* is out of alignment with the flange 320*b* on the interior release link 320. As a result, the interior release link 320 is free to move axially from the unactuated position thereof to the actuated position thereof, and cause the release member 92 to rotate.

The exterior and interior lock mechanisms are also illustrated in FIG. 26. An interior sill button 328 is operatively connected through a linkage 329 (shown schematically) to an interior lock bellcrank 330. The bellcrank 330 is pivotally mounted on a pivot pin 331 fixed to the flange 20 of the base plate 16. The pivot pin 331 is provided with an enlarged head 331*a* to retain the bellcrank 330 thereon. The bellcrank 330 is connected to the interior lock member 50 by an interior lock link 332, which engages the aperture 58 in the arm 54 of the interior lock member 50. Pulling up on the interior sill button 328 causes the linkage 329 to rotate the bellcrank 330 clockwise, rotating the interior lock member 50 clockwise to the unlock position thereof. Through the same mechanism, pushing down on the sill button 328 locks the latch assembly 310.

The exterior lock mechanism includes a key cylinder 334 which is operatively connected to a cam-lock link 336. The cam-lock link 336 is pivotally connected to the exterior lock member 60 by means of the aperture 74 formed in the arm 68 of the exterior lock member 60. Operation of the key cylinder 334 to an unlock position causes the cam-lock link 336 to rotate the exterior lock member 60 clockwise to the unlock position thereof. Similarly, operation of the key cylinder 334 to a lock position causes the exterior lock member 60 to rotate counterclockwise to the lock position thereof.

The spur 83 of the exterior lock member 60 may be formed without an aperture 83*a* therethrough. Instead, the spur 83 may be formed with a bifurcated lower surface (not shown) which cooperates with a lock lever detent 338 to more positively retain the exterior lock member 60 in a selected position. The lock lever detent 338 has a resilient arm 338*a* extending horizontally from a body portion 338*b*. The resilient arm 338*a* is provided with a bifurcated upper surface. The resilient arm 338*a* will bend downwardly when the exterior lock member 60 is operated to permit the spur 83 to pass thereover. During operation of the latch assembly 310, the detent 338 offers only slight resistance to movement of the exterior lock member 60, and the detent 338 will be overridden. However, the bifurcated upper surface of the resilient arm 338 of the lock lever detent 338 cooperates with the bifurcated lower surface of the spur 83*a* to urge the exterior lock member 60 toward the closer of the lock and unlock positions thereof. Thus, the resilient arm 338*a* is an over-center spring. The detent 338 prevents inadvertent movement of the exterior lock member 60, due to vehicle vibration for example. The detent 338 is preferably formed of a wear-resistant polymeric material, and is preferably fixed to the base plate 16.

A tension spring 340 is coupled between the release member 92 and a point fixed relative to the base plate 16, such as the body 338*b* of the detent 338. The spring 340 urges the release member 92 to rotate counterclockwise toward the normal (unactuated) position thereof. The release member 92 is prevented from counterclockwise rotation past the normal position by the interior release link 320 and the exterior release lever 312, which engage respective flanges 96 on the release member 92. When the release member is in the normal position thereof and the pawl 40 is in the engaged position thereof, the slot 94 in the release member 92 is vertically aligned with the notch 43 of the pawl 40 and the link pin 90 can be moved into the notch 43 to unlock the latch assembly 310. Thus the spring 340 facilitates unlocking of the latch assembly 310 by urging the release member 92 fully into the normal position thereof.

The actuator 341 of the latch assembly 310 includes a housing 342 of a molded plastic material. A plate portion 344 of the housing 342 has an opening 346 formed therethrough. A collar 348, similar to the collar 108 in the first embodiment described above, is formed about the opening 346.

An upstanding frame 350 is integrally formed with the plate portion 344 of the housing 342. An aperture 350a is formed in the frame 350, the purpose of which will be described below. The frame 350 is formed with various pockets and journals for mounting components therein. The electric motor 162 is mounted within the frame 350, as are the motor pinion 164, an idler gear 352, a clutch gear 354, a clutch 356, and a worm gear 358. The idler gear 352 and clutch gear 354 are preferably formed of a polymeric material such as nylon, while the worm gear 358 is preferably machined from steel, and the motor pinion 164 is formed of a powdered metal. A terminal block 360 is mounted on the exterior portion of the frame 350 to facilitate connecting an electrical power supply to the motor 162. The frame 350 encloses the components therein, except that the right side (as seen in FIG. 26) is closed by a permanently installed cover 362.

The motor pinion 164, as described above, is fixed to the output shaft of the motor 162. The motor pinion 164 meshes with the idler gear 352, which in turn meshes with and drives the clutch gear 354. The clutch gear 354 drives the input of the clutch 356. The clutch 356 is a conventional clutch of the type which couples the input and output thereof when the input revolves rapidly, but uncouples the input and output thereof when the input is at rest, even if the output is revolved rapidly in either direction. Thus the clutch 356 will be engaged when the motor 162 is energized, but disengage when the motor 162 is deenergized. The output of the clutch 356 is coupled to the worm gear 358.

The threads of worm gear 358 extend partially through the aperture 350*a* in the frame 350 to mesh with the teeth 364*a* of a sector gear 364. The sector gear 364 is pivotally mounted on the collar 348. The lead angle of the teeth 364a of the sector gear 364 should be such that the sector gear 364 is not self-locking. In other words, when the sector gear 364 is rotated by manual means, as will be described below, the sector gear 364 should be able to back-drive the worm gear 358 with little resistance. The clutch 356 disconnects the rest of the gear train from the worm gear 358 when the sector gear 364 is back driven, thereby minimizing the resistance experienced when manually operating the lock mechanism of the latch assembly 310.

The sector gear 364 includes a central bore 364*b* which is co-axial with the opening 346 in the plate portion 344 of the housing 342. The sector gear 364 is further provided with an upper surface 366. Three cam features 368 are formed on the upper surface 366. The cam features 368 are equally spaced apart about the periphery of the sector gear 364, and spaced outwardly from the central bore 364*b* through the sector gear 364. Each cam feature 368 includes a flat portion 368*a* and, in a counterclockwise direction from each flat portion 368*a*, an associated ramp portion 368*b* inclined downwardly to the upper surface 366 of the sector gear 364. Preferably, the sector gear 364 is integrally molded of a self-lubricating, wear resistant polymeric material.

As with the sector gear 112 in the first embodiment described above, the sector gear 364 may be selectively moved between a center position and unlock, lock, and double lock positions. A modular switch board 370 includes conventional button switches actuated by a feature (not shown) on the sector gear 364 to indicate when the sector gear 364 is in the lock, unlock or double-lock positions thereof. The modular switch board 370 provides logical input to the control circuit 163 (FIG. 2) controlling the remote operation of the latch assembly 310. For example, electronic logic may be provided in the control circuit 163 to prevent placing the latch assembly 310 in double lock and disabling the interior lock mechanism while the vehicle ignition circuit is energized. An energized vehicle ignition circuit is an indication that authorized occupants are still in the vehicle.

A control member 372 is provided with a cylindrical body 374 having an enlarged head 376. The body 374 of the control member 372 is disposed within the central bore 364*b* of the sector gear 364, and extends downwardly through the opening 346 in the housing 342. Two fingers 378 extend downwardly from the lower end of the body 374 to engage the notches 66 in the exterior lock member 60, and to selectively engage the notches 56 in the interior lock member 50. Three equally-spaced arms, 380, 382 and 384, extend radially outwardly from the head 376. The arm 384 is provided with a radially outwardly extending lug 386, which is similar in function to the lug 152 on the arm 146 of the first embodiment described above.

In a lowered position of the control member 372, the head 376 thereof bears against the upper surface 366 of the sector gear 364, and the arms 380, 282, and 284 extend outwardly between the cam features 368. The fingers 378 engage the interior lock member 50. In a raised position of the control member 372, the arms 380, 382, and 384 are positioned on top of the flat portions 368 of the respective cam features 368, the head 376 is raised off of the upper surface 366 of the sector gear 364, and the fingers 378 are disengaged from the interior lock member 50. Thus, when the control member 372 is in the raised position thereof, the latch assembly 310 is in a double lock position.

A lift ring 388 includes an arcuate body 390 mounted on the plate portion 344 of the housing 342, adjacent to the sector gear 364. A horizontally extending tab 392 is fixed to the body 390, and functions in a manner identical to that of the tab 174 of the latch assembly 10 described in the first embodiment above. An arm 394 extends from the body 390 over the control member 372. The arm 394 is provided with a downwardly extending boss 394*a* which retains and centers the spring 160 between the arm 394 and the control member 372. The spring 160 is compressed between the arm 394 and the control member 372. The arm 394 is provided with an upwardly extending tab 396. The center spring 136 is coupled between the tab 396 on the lift ring 388 and a feature (not shown) on the sector gear 364 to urge the sector gear 364 toward a center position.

An anti-theft shield 398 is mounted on the housing 344 adjacent to the frame 350. The cover 161 is fitted over the lift ring 388 and sector gear 364. The cover 161, the anti-theft shield 398, and the cover 362 cooperate to block access to the internal components of the actuator 341 when the door in which the latch assembly 310 is shut and the latch assembly 310 is locked.

The operation of the latch assembly 310 is essentially the same as the operation of the latch assembly 10 of the first embodiment described above. However, it should be noted that when the sector gear 364 drives the control member 372 toward the lock or unlock position thereof, each of the arms 380, 382, and 384 are engaged by a respective one of the cam features 368. Thus, balanced torque is applied evenly about the control member 372, and the control member 372 does not tend to tilt out of alignment with the axis of rotation of the sector gear 364, as might happen with only one arm on the control member 372 and heavy operating loads. Additionally, as the sector gear 364 is driven to the double lock position thereof, each of the arms 380, 382, and 384, engage a respective ramp portion of the cam features 368 to evenly lift the control member 372 to the raised position thereof. The control member 372 is lifted without tilting which could create large amounts of friction as the body 374 cants and engages the periphery of the opening 346 through the housing 342. Finally, while the center spring 136 returns the sector gear 364 to the center position thereof, the center spring 136 need only overcome the resistance of back-driving the worm gear 358, because the clutch 356 will uncouple the remaining gears and motor 162 from the worm gear 358.

In accordance with the provisions of the patent statutes, the principle and mode of operation of the present invention have been explained and illustrated in its preferred embodiment. However, it must be understood that the present invention may be practiced otherwise than as specifically explained and illustrated without departing from its spirit or scope.

What is claimed is:

1. A vehicle door latch including:

a locking fork moveable between latched and unlatched positions;

a pawl moveable between an engaged position for holding said locking fork in said latch position and a disengaged position permitting said locking fork to move to said unlatched position;

a selectively moveable operating member;

a link member moveable between a first position and a second position relative to said operating member, said link member operatively connecting said operating member to said pawl when said link member is in said first position, said operating member being selectively moveable when connected to said pawl to move said pawl to said disengaged position, said operating member being operatively disconnected from said pawl when said link member is in said second position;

a first locking member rotatable about an axis and operatively connected to said link member to selectively move said link member between said first position and said second position;

a second locking member rotatable about said axis; and a control structure moveable between a couple position and an uncouple position, said control structure operable in said couple position to cause said first and second locking members to be coupled such that rotation of said second locking member about said axis will cause said first locking member to rotate about said axis therewith to move said link member between said first and second positions.

2. The vehicle door latch of claim 1 wherein said control structure includes a finger moveable along a path spaced apart from said axis and operable to selectively simultaneously engage both of said first and second locking members.

3. The vehicle door latch of claim 1 wherein said first locking member includes a tab engaging said second locking member in an engaged position of said first and second locking members to couple said first and second locking members for simultaneous rotation, said control structure moving one of said first locking member and said second locking member axially from said engaged position to a disengaged position: wherein said tab is disengaged from said second locking member: when said control structure is moved from said couple position to said uncouple position.

4. The vehicle door latch of claim 1 wherein said second locking member includes a tab engaging said first locking member in an engaged position of said first and second locking members to couple said first and second locking members for simultaneous rotation, said control structure moving one of said first locking member and said second locking member axially from said engaged position to a disengaged position: wherein said tab is disengaged from said first locking member, when said control structure is moved from said couple position to said uncouple position.

5. The vehicle door latch of claim 1 wherein said control structure includes a control member adapted to be moved axially along said first axis for selectively uncoupling said first and second locking members.

6. The vehicle door latch of claim 5 wherein said coupling structure further includes a spring urging one of said first locking member and said second locking member into engagement with the other of said first locking member and said second locking member to couple said first locking member and said second locking member for simultaneous rotation.

7. A vehicle door lock assembly for a latch which includes a coupling member selectively moveable between a coupled position in which the latch is unlocked and an uncoupled position in which the latch is locked, the vehicle door lock assembly comprising:

a first locking member rotatable about an axis and operatively connectable to the coupling member of said latch to move the coupling member between the coupled position in which said latch is unlocked and tile uncoupled position in which said latch is locked;

a second locking member rotatable about said axis;

means for coupling said first and second locking members such that rotation of said second locking member about said axis will cause said first locking member to rotate about said axis therewith: and means for uncoupling said first and second locking members such that said first locking member is rotatable independently of said second locking member.

8. An actuator assembly for a vehicle door latch lock mechanism, comprising:

a control member operatively engaging said lock mechanism and rotatable about a first axis between a first position in which said lock mechanism is locked, and a second position in which said lock mechanism is unlocked, said control member having a first surface and a second surface; and a sector member selectively rotatable about said first axis and defining a recess, said recess having an edge wall defining a third surface and a fourth surface thereon, said third surface disposed to selectively engage said first surface of said control member to rotate said control member in a first direction to said first position when said sector member is rotated in said first direction, said fourth surface disposed to selectively engage said second surface of said control member to rotate said control member in a second direction to said second position when said sector member is rotated in said second direction.

9. The actuator assembly of claim 8 further including a stop limiting the rotation of said control member about said first axis in said first direction, said first surface and said third surface forming cooperating cam surfaces wherein, when said sector member urges said control member to rotate in said first direction and said control member is engaged by said stop, said cam surfaces cooperate to urge said control member to move axially along said first axis.

10. In combination with a latch mechanism actuatable between a locked and unlocked condition, a lock mechanism including:

a first locking member adapted to selectively rotate about a first axis between locked and unlocked positions respectively corresponding to the locked and unlocked conditions of the latch mechanism;

a second locking member adapted to rotate about said first axis;

means for coupling said first and second locking members such that said second locking member may be selectively rotated about said first axis to move said first locking member between said locked and unlocked positions; and means for uncoupling said first and second locking members such that said first locking member is operable to move between said locked and unlocked positions independently of said second locking member.

11. The lock mechanism of claim 10, wherein said means for uncoupling includes means for moving one of said first locking member and said second locking member along said first axis relatively away from the other of said first locking member and said second locking member.

12. The lock mechanism of claim 10, wherein said means for coupling and said means for uncoupling comprise an engaging member adapted for selective concurrent engagement of said first locking member and said second locking member.

13. The lock mechanism of claim 12, wherein said engaging member is adapted to move axially along a second axis, substantially parallel to said first axis, between a disengaged position in which said first locking member and said second locking member are uncoupled, and an engaged position in which said first locking member and said second locking member are concurrently engaged to couple said first locking member and said second locking member.

14. The vehicle door lock assembly of claim 7 wherein said means for coupling said first and second locking members and said means for uncoupling said first and second locking members define a control member selectively moveable along said axis between an engaged position and a disengaged position, said control member including a pair of spaced apart, axially extending fingers, said fingers extending between said first and second locking members and cooperating to couple said first and second locking members when said control member is in said engaged position, said first and second locking members being uncoupled when said control member is in said disengaged position.

15. The vehicle door lock assembly of claim 7 wherein said means for coupling includes a pair of spaced apart, axially extending tabs formed on one of said first and second locking members and a spring urging said first and second locking members relatively toward one another such that the other of said first and second locking members is engaged by said tabs, coupling said first and second locking members for simultaneous rotation about said axis, and wherein said means for uncoupling includes a control member selectively moveable to urge said first and second locking members apart such that said tabs do not engage the other of said first and second locking members, and said first locking member is rotatable independently of said second locking member.

* * * * *